US006443561B1

(12) United States Patent
Murakami

(10) Patent No.: US 6,443,561 B1
(45) Date of Patent: Sep. 3, 2002

(54) LIQUID DISCHARGE HEAD, DRIVING METHOD THEREFOR, AND CARTRIDGE, AND IMAGE FORMING APPARATUS

(75) Inventor: Shuichi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/643,822

(22) Filed: Aug. 22, 2000

(30) Foreign Application Priority Data

Aug. 24, 1999 (JP) ..... 11-236482

(51) Int. Cl.[7] ..... B41J 2/05
(52) U.S. Cl. ..... 347/57; 347/61; 347/63
(58) Field of Search ..... 347/56, 61, 62, 347/63, 59, 58, 57

(56) References Cited

U.S. PATENT DOCUMENTS

| | | | | |
|---|---|---|---|---|
| 5,206,659 | A | 4/1993 | Sakurai et al. | 347/62 |
| 5,218,376 | A | 6/1993 | Asai | 347/61 |
| 5,874,974 | A | 2/1999 | Courian et al. | 347/65 |
| 5,880,761 | A | 3/1999 | Uematsu et al. | 347/56 |
| 6,076,919 | A | 6/2000 | Shirota et al. | 347/60 |
| 6,109,718 | A | 8/2000 | Murakami et al. | 347/14 |
| 6,213,587 | B1 | 4/2001 | Whitman | 347/47 |

FOREIGN PATENT DOCUMENTS

| | | | |
|---|---|---|---|
| EP | 0792745 | 9/1997 | B41J/2/14 |
| EP | 0838337 | 4/1998 | B41J/2/14 |
| EP | 0867286 | 9/1998 | B41J/2/05 |
| JP | 54-161935 | 12/1979 | B41J/3/04 |
| JP | 61-185455 | 8/1986 | B41J/3/04 |
| JP | 61-249768 | 11/1986 | B41J/3/04 |
| JP | 4-10941 | 1/1992 | B41J/2/05 |

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head comprises discharge ports for discharging liquid; electrothermal transducing elements arranged to face the discharge ports; and a layer covering the electrothermal transducing elements. The gap between the discharge ports and the covering layer is 34 $\mu$m or less, and the thickness of the covering layer is 6,300 Å or less. One of the electrothermal transducing elements generates thermal energy of 0.0027 $\mu J/\mu m^2$ or less by the application of a single driving pulse of 1.2 $\mu$s or less to produce film boiling to discharge liquid from the corresponding discharge port. Fluctuation of liquid bubbling on the surface of the electrothermal transducing element is reduced, and since the resultant meniscus retraction becomes smaller upon discharge, liquid can return to the surface of the electrothermal transducing element quickly and the meniscus faces the discharge port, improving displacement accuracy of liquid droplets on a printing medium even when driving is executed at high frequency.

30 Claims, 25 Drawing Sheets

| FIG. 8A | FIG. 8B |
|---|---|

| FIG. 9A | FIG. 9B | FIG. 9C |
|---|---|---|

LIQUID DISCHARGE HEAD, DRIVING METHOD THEREFOR, AND CARTRIDGE, AND IMAGE FORMING APPARATUS

BACKGROUND OF THE INVENTION

1. Field of the Invention

The present invention relates to a liquid discharge head for discharging liquid and the driving method therefor, and a cartridge formed integrally with a liquid tank retaining liquid to be supplied to the liquid discharge head. The invention also relates to an image forming apparatus to form images on a printing medium. The invention is not only applicable to the printing apparatuses generally in use, but also, to a copying machine, a facsimile equipment provided with communication systems, and an apparatus having a printing unit, such a word processor. Further, the invention is applicable to an industrial recording system having various processing apparatuses complexly combined therein, as well as to a textile printing apparatus and a processing apparatus such as to perform etching or the like.

Here, the term "printing" or "recording" used for the specification hereof means not only the formation of characters, graphics, and other meaningful information, but also, it is meant to include, in a broad sense, images, designs, patterns, or the like formed on a printing medium, and also, to include processes such as etching, irrespective of being meaningful or otherwise, or being apparent to be visually recognizable by eyesight.

Also, the term "printing medium" means not only the paper sheet that is usually used for a printing apparatus in general, but it means cloth, plastic film, metallic plate, glass, ceramic, wood, leather, or the like, which is capable of receiving ink. Also, the printing medium may be a three-dimensional object, such as a spherical or cylindrical one, besides the one in the form of a sheet.

Further, the term "liquid" should also be interpreted in a broad sense as in the definition of the "printing (or recording)" as described above, and it is meant to include the one used for a printing medium to form images, designs, patterns, or the like, or used for etching process of a printing medium or ink processing (such as coagulating or insolubilizing coloring materials in ink to be used for a printing medium).

2. Related Background Art

For the liquid jet discharging method of ink jet type which is generally in use at present, there have been known the method that utilizes electrothermal transducing elements (heaters) as discharge energy generating elements used for discharging ink or the processing liquid which is used for adjusting the printability of ink on a printing medium (hereinafter referred to as collectively "ink" or "liquid" for the convenience' sake in the specification hereof), and the method that utilizes piezoelectric elements (piezo). Both of them make it possible to control the discharges of liquid droplets by the application of electric signals.

Now, for example, the principle of ink discharging method that uses electrothermal transducing elements is that with the application of electric signals to the electrothermal transducing elements, film boiling is created in ink instantaneously in the vicinity of the electrothermal transducing elements, and that ink droplets are discharged at high speed by the abrupt development of a bubble created by the phase changes of ink at that time. On the other hand, the principle of method for discharging ink droplets by use of piezoelectric elements is that with the displacement of piezoelectric elements by the application of electric signals, ink droplets are discharged by the pressure exerted when such displacement is effectuated.

Here, for the former method, there are advantages, among some others, that the space needed to provide the discharge energy generating elements can be smaller; the structure of ink jet head is made simpler; and the integration of nozzles is easer. However, as the characteristic drawback of this method, the voluminal changes of flying ink droplets may ensue from the accumulation of heat in the ink jet head due to heat generated by electrothermal transducing elements, and the electrothermal transducing elements are subjected to being affected by cavitation that may be brought about at the time of debubbling.

As one of the methods to solve the drawback described above, there are disclosed an ink jet printing method and an ink jet head in the specification of Japanese Patent Application Laid-Open No. 04-10941. The ink jet head disclosed in the specification thereof is provided with discharge ports for discharging ink, ink flow paths filled with ink, which is communicated with the discharge ports, and the electrothermal transducing elements formed with thin film resistive elements provided for ink flow paths to generate thermal energy. Then, when driving pulses are applied to them through electric wiring, thermal energy is generated, and the film boiling, which has been crated by the thermal energy, is developed. Then, utilizing the pressure of a bubble thus created ink droplets are discharged from the discharge ports. At this juncture, a bubble is communicated with the air outside. With this printing method, it becomes possible to stabilize the volume of flying ink droplets; to perform high speed printing using extremely fine ink droplets; and to enhance the durability of electrothermal transducing elements by eliminating cavitation at the time of debubbling. In this way, highly precise images can be obtained more easily.

SUMMARY OF THE INVENTION

One of the objects of the present invention is to attempt a further improvement of a liquid discharge head for discharging liquid by use of a bubble created by thermal energy, which enables a bubble to be communicated with the air outside, and also, the driving method therefor, a cartridge, and an image forming apparatus as well.

Another object of the invention is to provide a liquid discharge head for discharging liquid by use of a bubble created by thermal energy, which is capable of reducing unexpected non-discharges and the remaining bubble in a liquid chamber so as to discharge liquid stably from the discharge ports as droplets for the enhancement of displacement accuracy of the liquid droplets on a printing medium, hence performing high quality printing with excellent viscous plug properties, as well as to provide the driving method therefor, a cartridge, and an image forming apparatus.

It is still another object of the invention to provide a liquid discharge head which comprises discharge ports for discharging liquid; electrothermal transducing elements arranged to face the discharge ports for generating thermal energy utilized for discharging liquid from the discharge ports; and a covering layer for covering the electrothermal transducing element, residing inclusively between the electrothermal transducing element and liquid. For this liquid discharge head, the gap between the discharge port and the surface of the covering layer is 34 $\mu$m or less, and the thickness of the covering layer is 6,300 Å or less, and then, the electrothermal transducing element generates thermal energy of 0.0027 $\mu J/\mu m^2$ or less by the application of single driving pulse of 1.2 $\mu s$ or less for creating film boiling in liquid to discharge liquid from the discharge port.

It is a further object of the invention to provide a liquid discharge head which comprises discharge ports for discharging liquid; and electrothermal transducing elements for generating thermal energy utilized for discharging liquid from the discharge ports, the electrothermal transducing elements being directly in contact with liquid. For this liquid discharge head, the gap between the discharge port and the surface of the covering layer is 34 $\mu m$ or less, and the electrothermal transducing element generates thermal energy of 0.0027 $\mu J/\mu m^2$ or less by the application of single driving pulse of 1.2 $\mu s$ or less for creating film boiling in liquid to discharge liquid from the discharge port.

It is a further object of the invention to provide a method for driving a liquid discharge head having discharge ports for discharging liquid; electrothermal transducing elements arranged to face the discharge ports for generating thermal energy utilized for discharging liquid from the discharge ports; and a covering layer for covering the electrothermal transducing element, residing inclusively between the electrothermal transducing element and liquid, the gap between the discharge port and the surface of the covering layer being 34 $\mu m$ or less, and the thickness of the covering layer being 6,300 Å or less, which comprises the step of applying single driving pulse of 1.2 $\mu s$ or less to the electrothermal transducing element for generating thermal energy of 0.0027 $\mu J/\mu m^2$ or less to create film boiling in liquid for discharging liquid from the discharge port.

It is still a further object of the invention to provide a method for driving a liquid discharge head having discharge ports for discharging liquid; and electrothermal transducing elements for generating thermal energy utilized for discharging liquid from the discharge ports, the electrothermal transducing elements being directly in contact with liquid, and the gap between the discharge port and the surface of the covering layer being 34 $\mu m$ or less, which comprises the step of applying single driving pulse of 1.2 $\mu s$ or less to the electrothermal transducing element for generating thermal energy of 0.0027 $\mu J/\mu m^2$ or less to create boiling in liquid for discharging liquid from the discharge port.

It is another object of the invention to provide a cartridge which comprises a liquid discharge head provided with discharge ports for discharging liquid; electrothermal transducing elements arranged to face the discharge ports for generating thermal energy utilized for discharging liquid from the discharge ports; and a covering layer for covering the electrothermal transducing element, residing inclusively between the electrothermal transducing element and liquid, the gap between the discharge port and the surface of the covering layer being 34 $\mu m$ or less, and the thickness of the covering layer being 6,300 Å or less, and by applying single driving pulse of 1.2 $\mu s$ or less to the electrothermal transducing element for generating thermal energy of 0.0027 $\mu J/\mu m^2$ or less to create film boiling in liquid for discharging liquid from the discharge port; and a liquid tank for storing liquid to be supplied to the liquid discharge head.

Also, it is another object of the invention to provide cartridge which comprises a liquid discharge head provided with discharge ports for discharging liquid; and electrothermal transducing elements for generating thermal energy utilized for discharging liquid from the discharge ports, the electrothermal transducing elements being directly in contact with liquid, and the gap between the discharge port and the surface of the covering layer being 34 $\mu m$ or less, and by applying single driving pulse of 1.2 $\mu s$ or less to the electrothermal transducing element for generating thermal energy of 0.0027 $\mu J/\mu m^2$ or less to create boiling in liquid for discharging liquid from the discharge port; and a liquid tank for storing liquid to be supplied to the liquid discharge head.

Also, it is another object of the invention to provide an image forming apparatus which comprises a liquid discharge head provided with discharge ports for discharging liquid; electrothermal transducing elements arranged to face the discharge ports for generating thermal energy utilized for discharging liquid from the discharge ports; a covering layer for covering the electrothermal transducing element, residing inclusively between the electrothermal transducing element and liquid, the gap between the discharge port and the surface of the covering layer being 34 $\mu m$ or less, and the thickness of the covering layer being 6,300 Å or less; and a control unit for applying single driving pulse of 1.2 $\mu s$ or less to the electrothermal transducing element for generating thermal energy of 0.0027 $\mu J/\mu m^2$ or less to create film boiling in liquid for discharging liquid from the discharge port.

Also, it is another object of the invention to provide an image forming apparatus which comprises a liquid discharge head provided with discharge ports for discharging liquid; and electrothermal transducing elements for generating thermal energy utilized for discharging liquid from the discharge ports, the electrothermal transducing elements being directly in contact with liquid, and the gap between the discharge port and the surface of the covering layer being 34 $\mu m$ or less; and a control unit for applying single driving pulse of 1.2 $\mu s$ or less to the electrothermal transducing element for generating thermal energy of 0.0027 $\mu J/\mu m^2$ or less to create boiling in liquid for discharging liquid from the discharge port.

In accordance with the present invention, the gap between the discharge port and the electrothermal transducing element is 34 $\mu m$ or less, and also, the thickness of the covering layer is 6,300 Å or less. Then, by the application of single driving pulse of 1.2 $\mu s$ or less, thermal energy of 0.0027 $\mu J/\mu m^2$ or less is generated to create film boiling in liquid for discharging liquid from the discharge port. As a result, the fluctuation of liquid bubbling on the surface of the electrothermal transducing element is reduced to stabilize bubbling. Furthermore, since the resultant amount of meniscus retraction becomes smaller at the time of discharge, liquid can return to the surface of the electrothermal transducing element quicker so that meniscus faces the discharge port, hence making it possible to enhance the displacement accuracy of liquid droplets on a printing medium even when driving is executed at high frequency. Also, it becomes possible to reduce the electric power given to the electrothermal transducing element, which contributes to enabling meniscus to return quickly and face the discharge port. As a result, the wetted liquid on the discharge port surface is allowed to be combined with the liquid which is being refilled in the discharge port, which makes it possible to reduce the occurrence of unexpected non-discharges.

With the electrodermal transducing element being configured to be square, it becomes possible to enhance the viscous plug properties of ink droplets more if the distance L is made smaller by 1.3 times the length of one side of such electrothermal transducing element.

With the discharge ports arranged at least in two lines parallel to each other arranged at intervals of 600 dpi, respectively, it becomes possible to obtain a liquid discharge head whose performance is as high as 1,200 dpi if the arrangement pitches are deviated by half pitch from each other per line.

With the amount of discharge of liquid being 5 picoliters or less when discharged from the discharge port by the application of single driving pulse to the electrothermal transducing element, it becomes possible to enhance resolution of images for the significant improvement of the quality of images thus obtained.

With driving means of the liquid discharge head being provided with the base plate having wiring section formed on the electrothermal transducing element in the scanning movement direction of the carriage, it becomes possible to uniform the temperature distribution on the surface of each individual electrothermal transducing element in the arrangement direction of the discharge port, thus suppressing the inclination of discharge direction of liquid droplets in the arrangement direction of discharge ports, and preventing the occurrence of white streaks or the like.

DETAILED DESCRIPTION OF THE PREFERRED EMBODIMENTS

At first, for the ink jet head that discharges ink from the discharge ports as droplets by utilization of the pressure of a bubble created by driving electrothermal transducing elements, while this bubble is communicated with the air outside, there are mainly four problems given below. Now, hereunder, these problems will be described with reference to the accompanying drawings.

Figure 26:
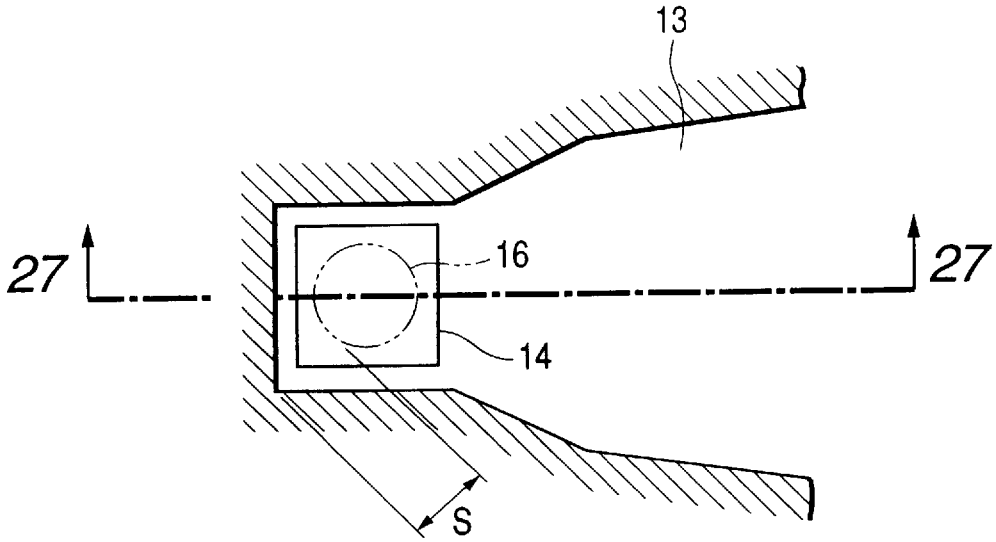
FIG. 26 is a cross-sectional view which shows the structure of one ink chamber of the objective ink jet head of the present invention.
Figure 27:
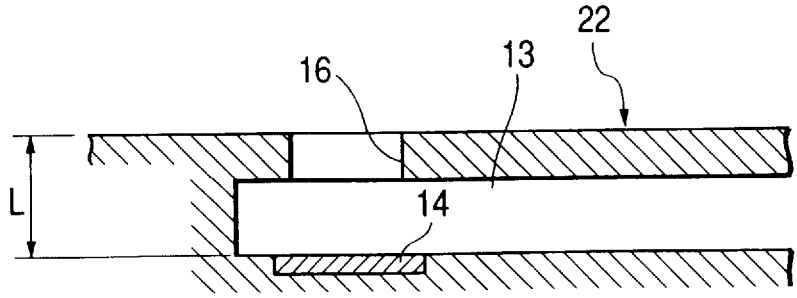
FIG. 27 is a cross-sectional view taken along line 27—27 indicated by arrows in FIG. 26.

Firstly, as compared with the ink jet head which is not arranged to enable a bubble to communicate with the air outside, there is a need for the head to make the gap L smaller from the surface of liquid contact on the electrothermal transducing element 14 to the discharge port surface 22 where discharge ports 16 are open in order to discharge ink from the discharge ports with the bubble being communicated with the air outside. FIG. 26 is a upper sectional view which shows the plane structure of the ink chamber portion of an ink jet head. FIG. 27 is a side sectional view taken along line 27—27 in FIG. 26.

Figure 28:
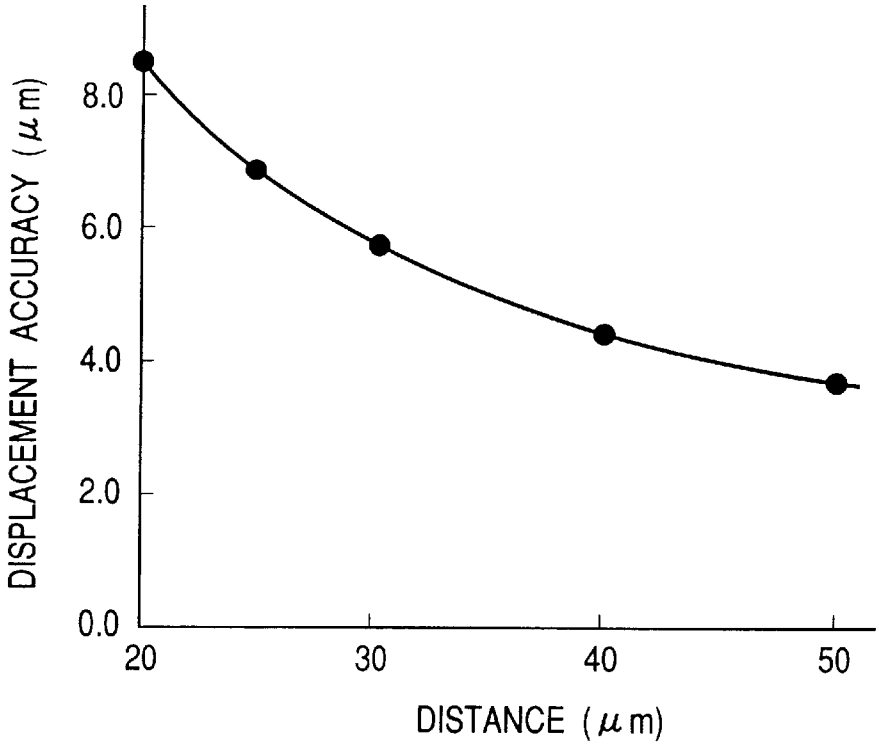
FIG. 28 is a graph which shows the relationship between the distance from the electrothermal transducing element to the discharge port surface, and the displacement accuracy of ink droplets.
Figure 29:
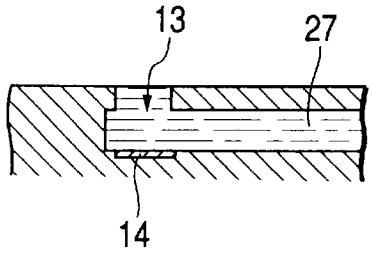
FIG. 29 is a view of the first discharging principle which illustrates the discharging process of an ink droplet from a discharge port together with the representations in FIG. 30 to FIG. 34, respectively.

However, as shown in FIG. 28 which shows the relationship between the distance L from the liquid contact surface on the electrothermal transducing element 14 to the discharge port surface 22 where the discharge ports 16 are open, and the displacement accuracy of ink droplets on a printing medium in the arrangement direction of the discharge ports 16, there is a tendency that the smaller the distance L, the more becomes unfavorable the displacement accuracy of ink droplets. Conceivably, this is because of the fluctuation of bubbling initiation time on the surface of the electrothermal transducing element 14, which is created due to ink burning or fine irregularities on or damages given to the surface of the electrothermal transducing element 14, while the length of passage is not sufficient in order to correct the changes in the flow direction of ink droplets, which may be brought about by such causes, to a specific direction.

The inventors hereof has purposely set the distance L between the liquid contact surface on the electrothermal transducing elements and the discharge port surface within a range where the displacement accuracy is not very good in accordance with the conventional art, that is, this distance is set at a comparatively small value, and then, it is made an objective at first to perform a highly precise recording by discharging comparatively small liquid droplets stably. More specifically, the aforesaid distance L is set at 34 $\mu$m or less. This distance L should preferably be 16 $\mu$m or more. Also, it is extremely preferable to adopt a method whereby to enable the bubble created by means of film boiling to be communicated with the air outside as a method for discharging liquid.

Then, the inventors hereof have found that if one main droplet is discharged from one discharge port by giving plural driving pulses to the electrothermal transducing element particularly when the aforesaid distance L is as comparatively small as 34 $\mu$m or less, the liquid temperature near the electrothermal transducing element rises by the driving pulse given at first, which tends to facilitate the creation of fine bubble, and that the factor that causes the instability of bubbling becomes comparatively conspicuous. With this phenomenon in view, the inventors hereof have studied and come to the conclusion that a single driving pulse is superior in terms of the stability when one main droplet is discharged from one discharge port with the aforesaid distance L being comparatively small as 34 $\mu$m or less. Also, it has been found disable to make this single driving pulse rectangular.

In continuation, the inventors hereof have set the pulse width of the single driving pulse at 1.2 $\mu$s or less so that the electrothermal transducing element generates thermal energy of 0.0027 $\mu J/\mu m^2$ or less for the creation of film boiling in order to discharge liquid from the discharge port. In this way, it becomes possible to stabilize bubbling because the fluctuation of liquid bubbling is reduced on the surface of the electrothermal transducing element. Also, the degree of the meniscus retraction becomes smaller at the time of discharges. As a result, liquid returns to the surface of the electrothermal transducing element rapidly to enable the meniscus to be confronted with the discharge port, hence improving the displacement accuracy of liquid droplets on a printing medium even if driving is performed at high frequency. Then, it is possible to compensate sufficiently for a slight deterioration of the displacement accuracy of liquid droplets that may be brought about from the aforesaid distance L which is set to be as comparatively small as 34 $\mu$m or less. The pulse width of the single driving pulse should preferably be 0.6 $\mu$s or more. It is also preferable to make thermal energy generating by the electrothermal transducing element 0.0013 $\mu J/\mu m^2$ or more.

Further, the inventors hereof pay attention to the covering layer to cover the electrothermal transducing element, which resides inclusively between liquid and the electrothermal transducing element, and regulate the thickness of the covering layer to be 6,300 Å or less from the comprehensive viewpoint that includes the minimum requirement of protective property for the electrothermal transducing element, the heat transfer capability to transfer the thermal energy generated by the electrothermal transducing element to liquid effectively, and the heat radiation property to radiate heat remaining in the covering layer. It is preferable to make the thickness of the covering layer 3,000 Å or more.

Here, additionally, although the description has been made simply of the time series processes in which the inventors hereof have designed the present invention, the actual result has been obtained only by the industrious studies accompanied by serious trial and error before having it to be designed as described in the specification hereof.

Secondly, for the so-called side shooter type where the ink jet head has the electrothermal transducing elements 14 and the discharge ports 16 arranged to face each other, respectively, ink mist adheres to the discharge port surface 22 during the printing operation and creates "wetting" condition, which may result in disabled discharges of ink droplets (hereinafter, this condition is referred to as an "unexpected non-discharge"). This may lead to the drawback that the so-called white streaks are created on a printing medium. An unexpected non-discharges of the kind is a phenomenon occurring on one discharge port 16 as a unit. If the unexpected non-discharge takes place on a specific discharge port 16, it becomes difficult to recover it unless recovery means, such as suction, is used. In this respect, the aforesaid unexpected non-discharges are not easily generated for an ink jet head of a type where no bubbling is communicated with the air outside.

Figure 30:
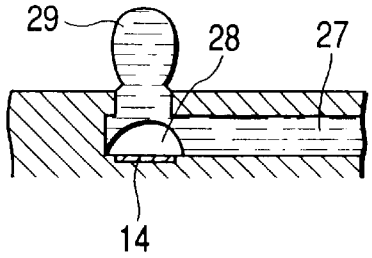
FIG. 30 is a view of the first discharging principle which illustrates the discharging process of an ink droplet from a discharge port together with the representations in FIG. 29, and FIG. 31 to FIG. 34, respectively.
Figure 31:
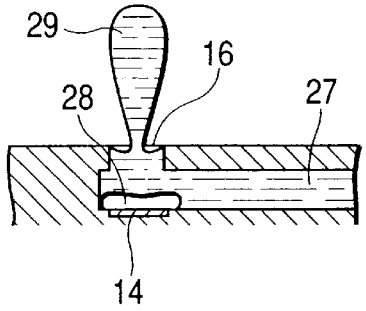
FIG. 31 is a view of the first discharging principle which illustrates the discharging process of an ink droplet from a discharge port together with the representations in FIG. 29, FIG. 30, and FIG. 32 to FIG. 34, respectively.
Figure 32:
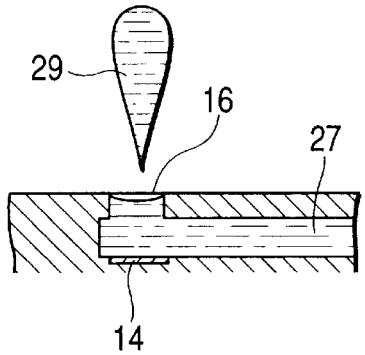
FIG. 32 is a view of the first discharging principle which illustrates the discharging process of an ink droplet from a discharge port together with the representations in FIG. 29 to FIG. 31, FIG. 33, and FIG. 34, respectively.
Figure 33:
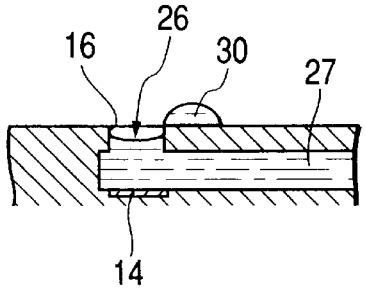
FIG. 33 is a view of the first discharging principle which illustrates the discharging process of an ink droplet from a discharge port together with the representations in FIG. 29 to FIG. 32, and FIG. 34, respectively.
Figure 34:
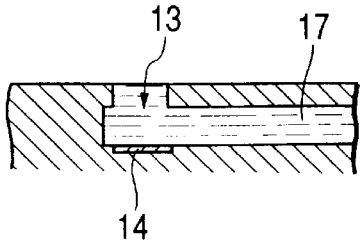
FIG. 34 is a view of the first discharging principle which illustrates the discharging process of an ink droplet from a discharge port together with the representations in FIGS. 29 to FIG. 33, respectively.
Figure 35:
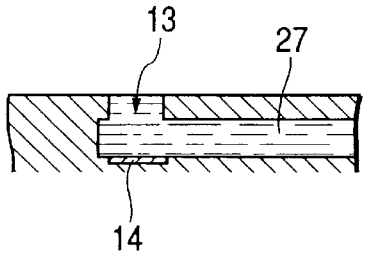
FIG. 35 is a view of the second discharging principle which illustrates the discharging process of an ink droplet from a discharge port together with the representations in FIG. 36 to FIG. 39, respectively.
Figure 36:
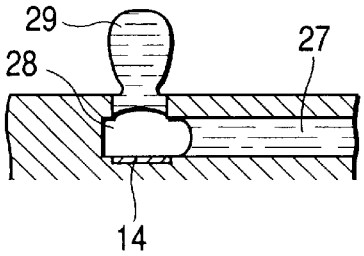
FIG. 36 is a view of the second discharging principle which illustrates the discharging process of an ink droplet from a discharge port together with the representations in FIG. 35, and FIG. 37 to FIG. 39, respectively.
Figure 37:
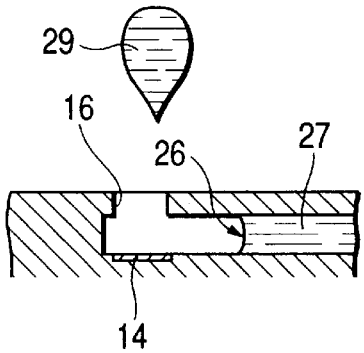
FIG. 37 is a view of the second discharging principle which illustrates the discharging process of an ink droplet from a discharge port together with the representations in FIG. 35, FIG. 36, FIG. 38, and FIG. 39, respectively.

FIG. 29 to FIG. 34 are views which illustrate the discharge process of an ink droplet for an ink jet head of the kind. In other words, the electrothermal transducing element 14 is driven as shown in FIG. 30 by the application of electric signals from the initial state of discharge operation shown in FIG. 29. Then, a bubble 28 is created in ink 27 in the ink chamber 13 to bring the ink droplet 29 to be in a state of being discharged. The bubble 28 thus actuated is made smaller as shown in FIG. 31 and FIG. 32 with the reduction of the inner pressure in the ink chamber 13, and the bubble becomes extinct. As a result, ink 27 still remains on the surface of the electrothermal transducing element 14 even after discharge, and the ink meniscus 26 also advances to the vicinity of the opening of the discharge port 16. Therefore, even if wetted ink 30 is present in the vicinity of the discharge port 16 as shown in FIG. 33, it becomes possible to draw in this wetted ink 30 into the ink 27 that resides in the discharge port 16 as shown in FIG. 34. Here, even if it should be impossible to draw the wetted ink 30 into the discharge port 16, the clogging of the discharge port 16 can be easily eliminated by bubbling ink 27 residing on the surface of the electrothermal transducing element 14.

Figure 38:
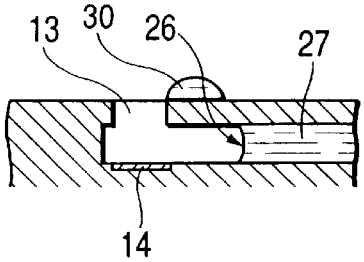
FIG. 38 is a view of the second discharging principle which illustrates the discharging process of an ink droplet from a discharge port together with the representations in FIG. 35 to FIG. 37, and FIG. 39, respectively.
Figure 39:
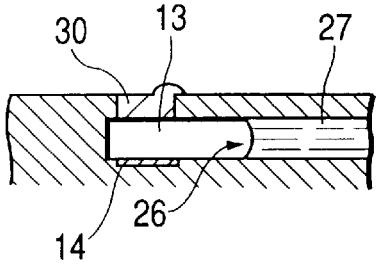
FIG. 39 is a view of the second discharging principle which illustrates the discharging process of an ink droplet from a discharge port together with the representations in FIG. 35 to FIG. 38, respectively.

However, for the ink jet head of a type where ink is discharged from discharge ports as droplets, while bubbling is communicated with the air outside, ink is subjected easily to being pooled in the vicinity of discharge ports, respectively, if the width of driving pulse is larger to make the discharge instable when ink 27 is bubbled to create a bubble 28 for discharging the ink droplet 29 as shown in FIG. 35 to FIG. 39 which illustrate the discharge processes of the ink droplet. As a result, ink 27 no longer exists on the surface of the electrothermal transducing element 14 to cause the ink meniscus 26 to be retracted. It has been found, then, that the discharge port 16 is clogged in some cases by the wetted ink 30 before ink 27 is refilled. Particularly, when the ink meniscus 26 has been retracted as shown in FIG. 38, it becomes impossible not only to draw in the wetted ink 30 into the ink 27 side, but also, it becomes impossible to eliminate the clogged condition of the discharge port 16, which has been caused by the presence of the wetted ink 30, by discharging ink 27 on the electrothermal transducing element 14. Therefore, in order to eliminate the clogged condition of the discharge port 16, there is no other means but to wait until the bubble 28 which still remains in the ink chamber 13 is dissolved into ink 27 or to remove the clogging by the wetted ink 30 using recovery means or the like.

Figure 40:
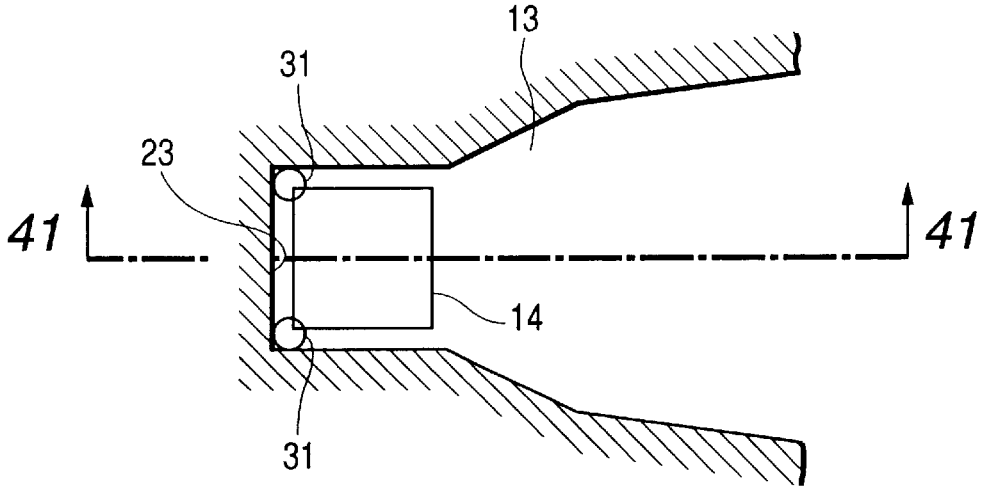
FIG. 40 is a cross-sectional view which shows the structure of one ink chamber of the objective ink jet head of the present invention.
Figure 41:
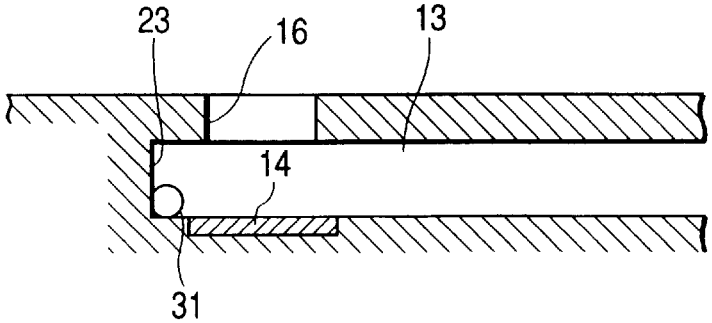
FIG. 41 is a cross-sectional view taken along line 41—41 indicated by arrows in FIG. 40.

Thirdly, for the ink jet head of side shooter type, a drawback is created to pool bubbles 31 on both end portions of the edge wall 23 of the ink chamber 13 as shown in FIG. 40 which schematically shows the structure of the ink chamber, and in FIG. 41 which is a cross-sectional view taken along line 41—41 indicated by arrows in it. The remaining bubbles 31 are created as a phenomenon characteristic to the ink jet head of the type where ink is discharged while bubbling is communicated with the air outside when the air is induced into the ink chamber 13 from the discharge port 16 at the time of discharge or when the air which is dissolved to remain in ink becomes a bubble, among some other causes. Also, the remaining bubbles 31 tend to get together on both end portions in the widthwise direction of the edge wall 23 of the ink chamber 13 due to ink flowing by bubbling, because the electrothermal transducing element 14 is arranged in a state of being encircled by the ink chamber 13. Also, it has been found that as shown in FIG. 26, the longer the distance S becomes from one end portion in the widthwise direction of the edge wall 23 to the corner portion of the discharge port 16, the more the volume is increased for each of the remaining bubbles 31 which reside on both end portions in the widthwise direction of the edge wall 23 of the ink chamber 13. With the existence of the remaining bubbles 31 on both end portions of the edge wall 23 of the ink chamber 13, the discharging pressure is reduced and offset by the remaining bubbles 31 at the time of discharge. As a result, the discharges of ink droplets become instable to cause the reduction of the discharge speed and the discharge amount or a drawback takes place to deviate discharges from the discharge direction originally designated. Particularly, if the distance S is made longer from the one end portion in the widthwise direction of the edge wall 23 to the corner portion of the discharge port 16, the aforesaid phenomenon becomes more conspicuous. Then, when characters and others are printed on a printing medium, white streaks are created, and along with the reduction of the ink discharge amount, the printing density is caused to be lowered.

Fourthly, if the discharge port is arranged to be smaller still in order to make ink droplets extremely fine, it becomes easier for the ink, which has become overly viscous due to the moisture evaporation, to clog the discharge port to deteriorate the viscous plug properties of ink. Here, the "viscous plug properties" of ink means whether or not a printing operation can be carried out again normally when the printing operation should be executed after the passage of a specific period of time subsequent to having executed a printing operation by discharging ink droplets from the ink jet head. Generally, the longer the time of suspension, the more is the tendency that the viscous plug properties is deteriorated, because the moisture contained ink confronted with the discharge port is more evaporated. If the viscous plug properties of ink becomes deteriorated, ink mist or the like tends to adhere to a printing medium due to the instable ink discharges from the discharge ports or ink discharges from the discharge ports become disabled to make it impossible to carry on the normal printing operation in some cases.

Now, hereunder, with reference to the accompanying drawings, the detailed description will be made of the embodiments in which the present invention is applied to an ink jet printer. Here, it is to be understood that the invention is not necessarily limited to such embodiments. The invention is applicable to the combination of such embodiments, as well as to any other techniques to be included in the conception of the invention referred to in the claims following the description of the specification hereof.

(The Main Body of the Apparatus)

Figure 1:
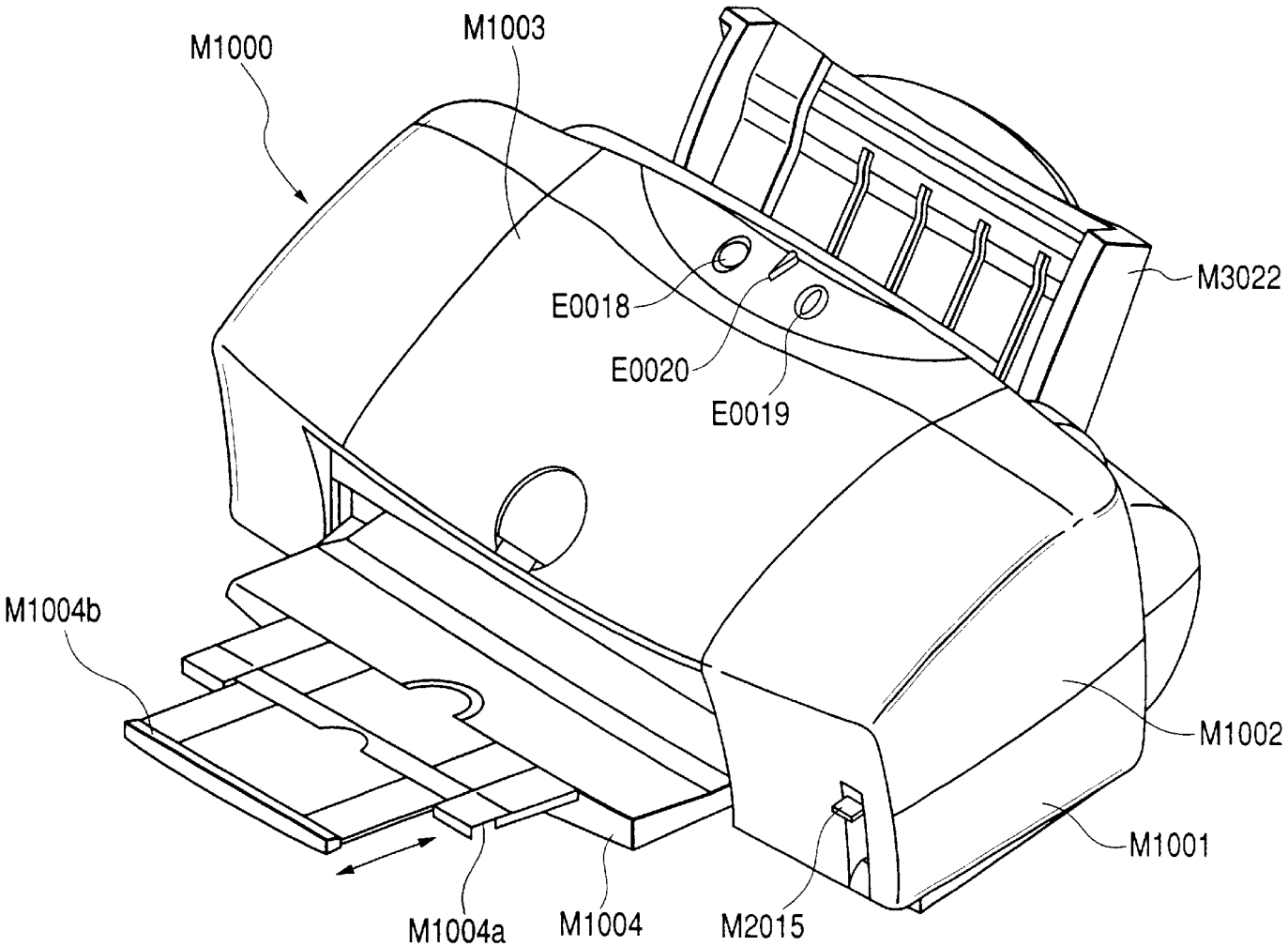
FIG. 1 is a perspective view which shows the outer structural appearance of an ink jet printer embodying the present invention.
Figure 2:
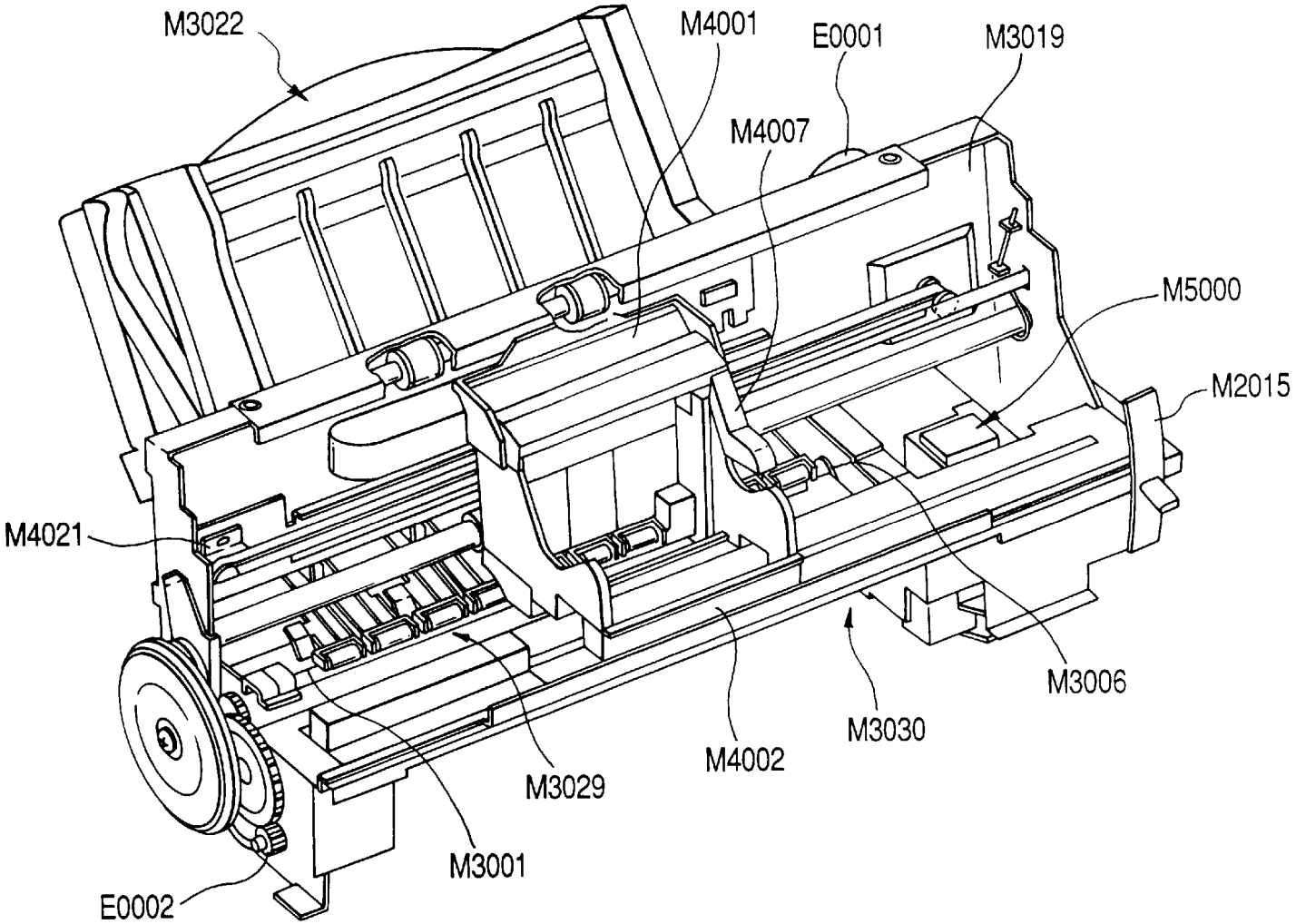
FIG. 2 is a perspective view which shows the state where the exterior members are removed from the printer shown in FIG. 1.

FIG. 1 and FIG. 2 are views which schematically illustrate the structure of a printer using ink jet recording method. In FIG. 1, the apparatus main body M1000, which constitutes the outer housing of the printer in accordance with the present embodiment, comprises a lower case M1001; an upper case M1002; an access cover M1003 and an external member for exhaust tray M1004; and a chassis M3019 (see FIG. 2) housed in the interior of external members.

The chassis M3019 is formed by plural metallic plate members having a predetermined rigidity, which constitutes the skeleton of the recording apparatus to support each mechanism of various recording operations to be described later.

Also, the lower case M1001 forms substantially the lower half of the apparatus main body M1000, and the upper case M1002 forms substantially the upper half of the apparatus main body M1000, respectively. Then, by the combination of both cases, a hollow structure is formed with a space to house each of the mechanisms in it which will be described later. Then, on the upper portion and front portion thereof, openings are formed, respectively.

Further, one edge portion of the exhaust tray M1004 is rotatively supported by the lower case M1001 to make it possible to open and close the opening formed on the front portion of the lower case M1001 by the rotation thereof. As a result, when a recording operation is performed, the opening is made ready by rotating the exhaust tray M1004 to the front side, thus exhausting the recording sheet P from this opening to stack it one by one. Also, for the exhaust tray M1004, two auxiliary trays M1004*a* and M1004*b* are retractively arranged, which can be pulled out, respectively, from the front side as needed, thus making the supporting area of a recording sheet larger or smaller in three stages.

One edge portion of the access cover M1003 is rotatively supported by the upper case M1002 to make it possible to open and close the opening formed on the upper surface. With the access cover M1003 being open, the recording head cartridges H1000 or the ink tanks H1900 which are installed on the interior of the apparatus main body can be exchanged. Here, although not shown particularly, an extrusion is arranged on the reverse side of the access cover M1003, which enables a lever for opening and closing the cover to rotate when the access cover is open or closed. Then, it is arranged to sense the rotated position of the lever by a microswitch or the like to detect the open or closed state of the access cover.

Also, on the upper face of the rear portion of the upper case M1002, a power source key E0018 and a resume key E0019 are arranged to be depressed, and at the same time, an LED E0020 is arranged for the respective operations. Then, when the power source key E0018 is depressed, the LED E0020 is illuminated to let the operator know that recording is made ready. Also, various indicating functions are arranged to let the operator know of the printer trouble or the like by the way of blinking of the LED E0020, the illuminated color thereof, or by sounding a buzzer E0021 (see FIG. 7). Here, when trouble or the like has been solved, recording is resumed by depressing the resume key E0019.

(The Mechanism of Recording Operation)

Now, the description will be made of the mechanism of recording operation, which is installed and supported by the main body M1000 of the printer in accordance with the present embodiment.

For the present embodiment, the mechanism of recording operation comprises an automatic feeder M3022 that automatically feeds the recording sheets P to the interior of the apparatus main body; a carrier unit M3029 that carries each of the recording sheets P fed from the automatic feeder one by one, and at the same time, guides the recording sheet P from the recording position to the exhaust unit M3030; a recording unit to perform a desired recording on the recording sheet P carried onto the carrier unit M3029; and a recovery unit (M5000) that performs recovery process for the recording unit or the like.

(Recording Unit)

Here, the aforesaid recording unit will be described.

The recording unit comprises a carriage M4001 movably supported by the carriage shaft M4021, and the recording head cartridge H1000 detachably mountable on the carriage M4001.

Recording Head Cartridge. In conjunction with FIG. 3 to FIG. 5, a recording head cartridge will be described at first.

Figure 3:
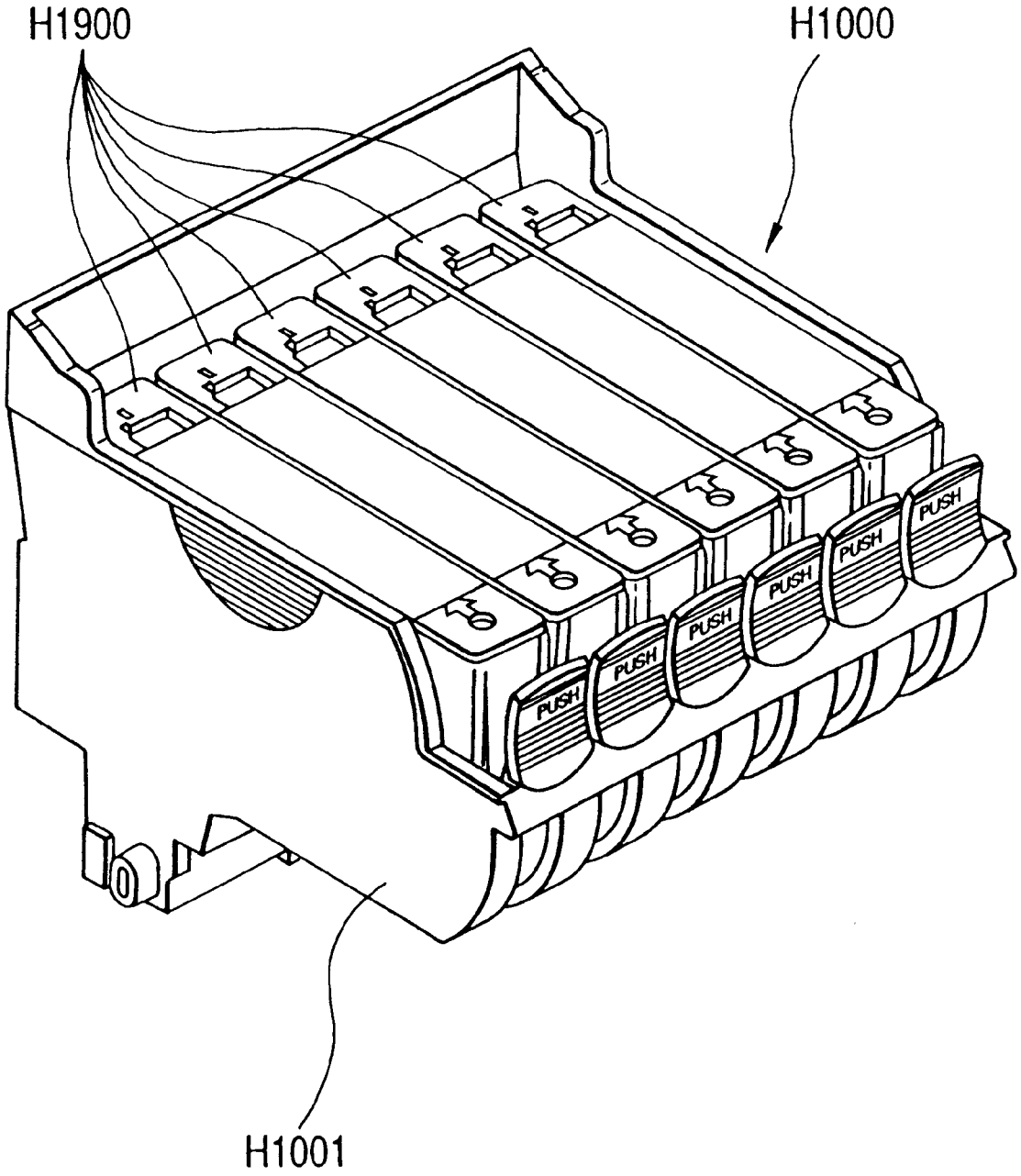
FIG. 3 is a perspective view which shows the state where the recording head cartridge is assembled for use in accordance with the embodiment of the present invention.

The recording head cartridge H1000 of the present embodiment is provided with an ink tank H1900 that retains ink as shown in FIG. 3, and a recording head H1001 that discharges from nozzles the ink which has been supplied from the ink tank H1900 in accordance with recording information. Here, the recording head H1001 adopts the so-called cartridge system where the head is made detachably mountable on the carriage M4001 to be described later.

Figure 4:
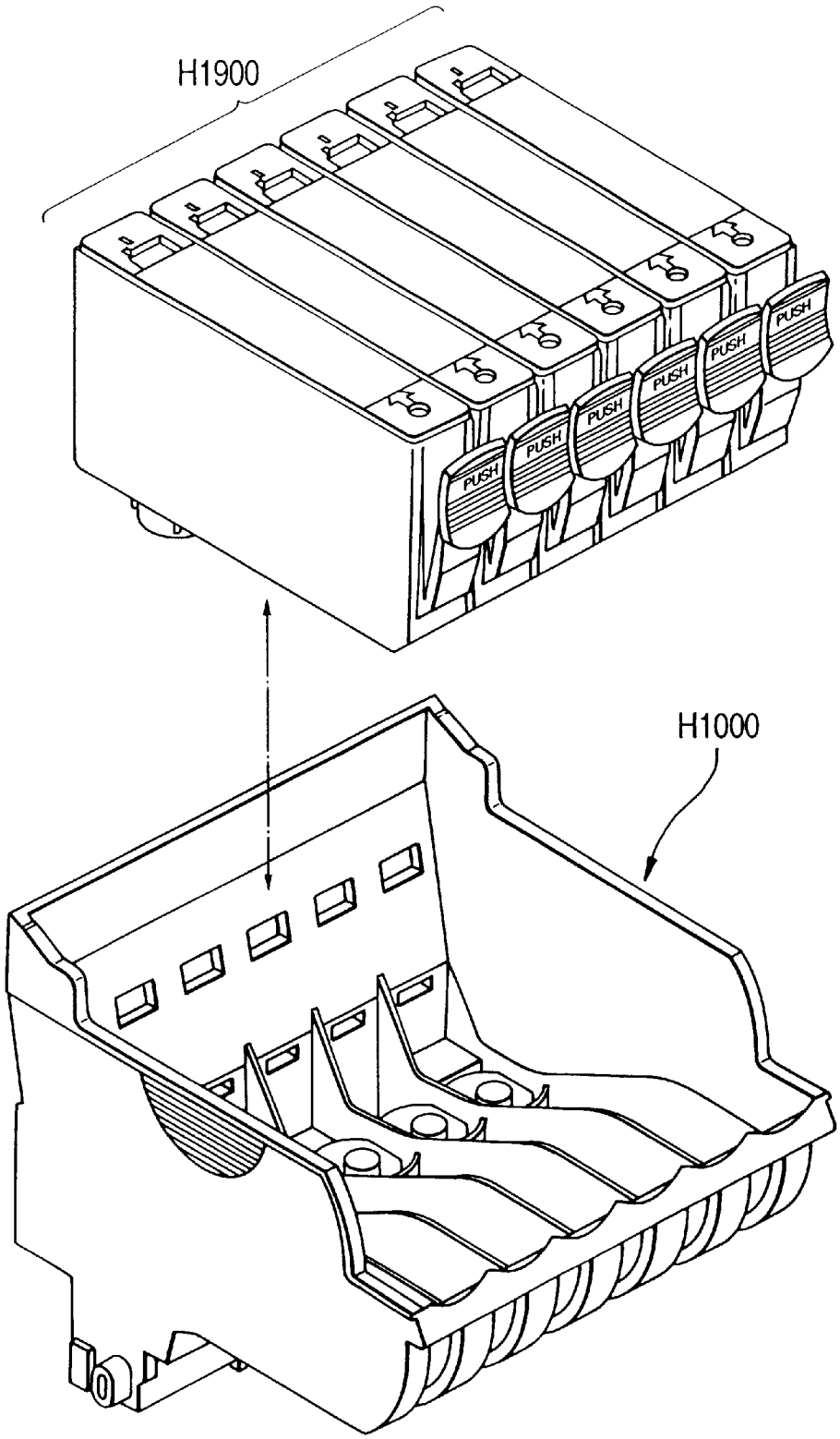
FIG. 4 is an exploded perspective view which shows the recording head cartridge represented in FIG. 3.

For the recording head cartridge H1000 shown here has ink tanks which are prepared individually for each color of black, light cyan, light magenta, cyan, magenta, and yellow, respectively, as shown in FIG. 4. Each of them is arranged to be detachably mountable on the recording head H1001.

Figure 5:
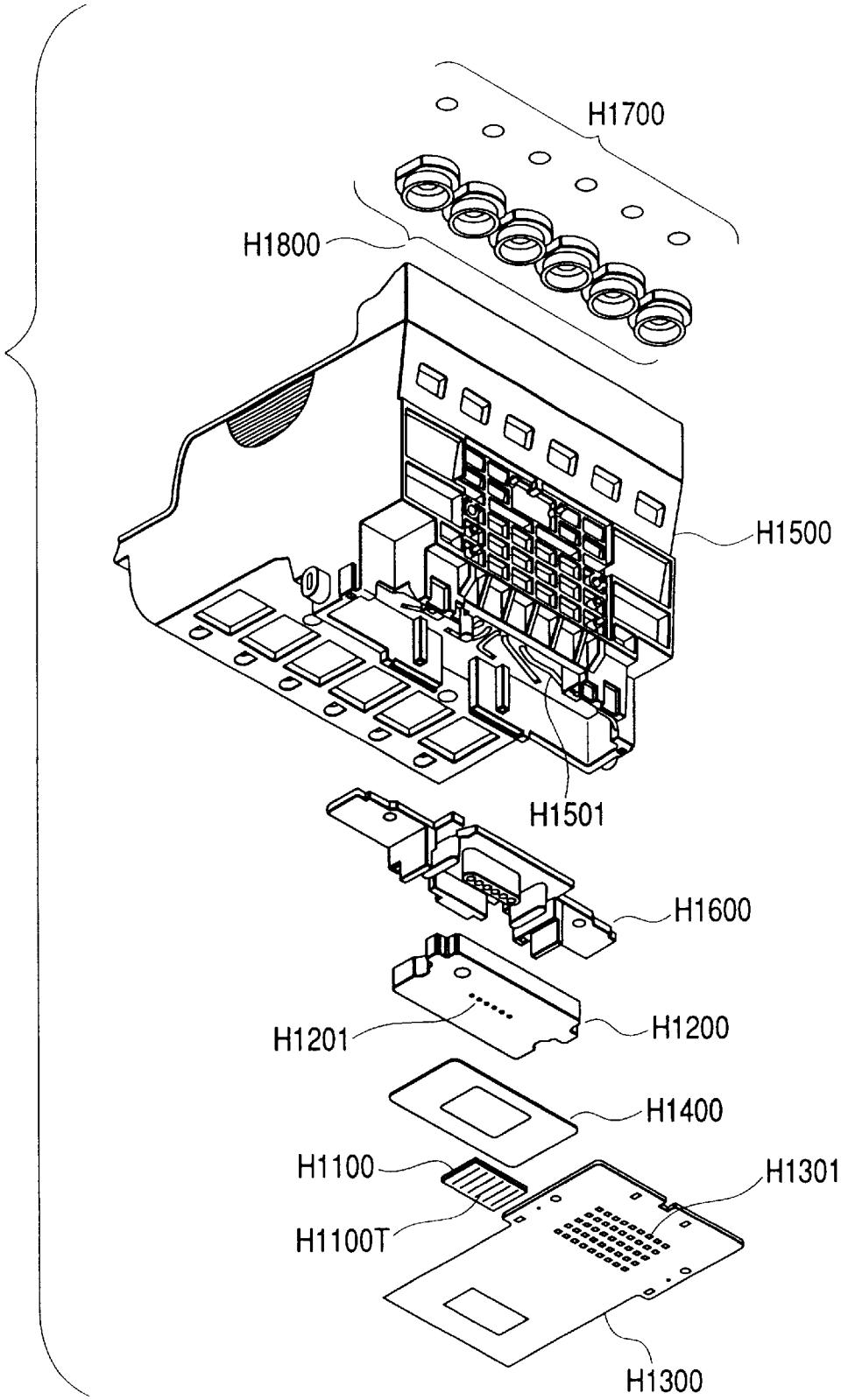
FIG. 5 is an exploded perspective view which shows the recording head represented in FIG. 4, observed diagonally from below.

Then, as shown in FIG. 5 which is an exploded perspective view, the recording head H1001 comprises a recording element base plate H1100; a first plate H1200; an electric wiring base plate H1300; a second plate H1400; a tank holder H1500; a flow path forming member H1600; a filter H1700; and a sealing rubber H1800.

For the recording element base plate H1100, a plurality of recording elements that discharge ink, and the electric wiring of Al or the like to supply electric power to each of the recording elements are formed by means of film formation technologies and techniques on one side of the Si base plate. Then, corresponding to the recording elements, a plurality of ink flow paths and discharge ports H1100T are formed by means of the photolithographic process, and at the same time, an ink supply port is formed to open to the reverse side thereof in order to supply ink to a plurality of ink flow paths. Also, the recording element base plate H1100 is bonded and fixed to the first plate H1200. Here, the ink supply port H1201 is formed to supply ink to the recording element base plate H1100. Further, the second plate H1400 having an opening is bonded and fixed to the first plate H1200. The second plate H1400 holds the electric wiring base plate H1300 so that the electric wiring base plate H1300 and the recording element base plate H1100 are electrically connected. The electric wiring base plate H1300 is to apply electric signals to the recording element base plate H1100 for discharging ink, which comprises the electric wiring corresponding to the recording element base plate H1100, and the external signal input terminal H1301 positioned on the electric wiring edge portion to receive electric signals from the main body. The external signal input terminal H1301 is positioned and fixed on the backside of the tank holder H1500 which will be described later.

On the other hand, the flow path forming member H1600 is welded by means of ultrasonic waves to the tank holder H1500 that detachably supports the ink tank H1900, thus forming the ink flow path H1501 from the ink tank H1900 to the first plate H1200. Also, for the edge portion of the ink flow path H1501 on the ink tank side, which engages with the ink tank H1900, the filter H1700 is installed to prevent dust particles from entering from the outside. Also, the sealing rubber H1800 is applied to the coupling portion with the ink tank H1900 in order to prevent ink from being evaporated from the coupling portion.

Further, as described earlier, the tank holder unit, which comprises the hank holder H1500, the flow path forming member H1600, the filter H1700, and the sealing rubber H1800, is coupled by bonding or the like with the recording element unit which comprises the recording element base plate H1100, the first plate H1200, the electric wiring base plate H1300, and the second plate H1400, thus forming the recording head H1001.

(Carriage)

Now, in conjunction with FIG. 2, the carriage M4001 will be described.

As shown in FIG. 2, the carriage M4001 is provided with the carriage cover M4002 which engages with the carriage M4001 to guide the recording head H1001 to the installation position of the carriage M4001, and a head setting lever M4007 which engages with the tank holder H1500 of the recording head H1001 to compress the recording head H1001 so that it is set in the predetermined installation portion.

In other words, the head setting lever M4007 is rotatively installed on the upper part of the carriage M4001 centering on the head setting lever shaft, and at the same time, a head setting plate (not shown) is provided for the coupling portion with the recording head H1001 through a spring. Then, the structure is arranged so that with the force exerted by this spring, the recording head H1001 is compressed and installed on the carriage M4001.

Also, the coupling portion of the carriage M4001 other than the coupling portion with the recording head H1001 is provided with a contact flexible printed cable (hereinafter referred to as the contact FPC) E0011, and the contact portion of the contact FPC E0011 and the contact unit (external signal input terminal) H1301 provided for the recording head H1001 are electrically in contact to make it possible to transfer and receive various kinds of information for recording and the supply of electric power to the recording head H1001, among some others.

Here, an elastic member, such as rubber (not shown), is provided between the contact portion of the contact FPC E0011 and the carriage M4001 to keep the contact portion and the carriage M4001 securely in contact by means of the elastic force of this elastic member and the spring force of the head setting lever. Further, the contact FPC E0011 is connected with the carriage base plate E0013 installed on the reverse side of the carriage M4001 (see FIG. 7).

(Scanner)

The printer of the present embodiment is also usable as a reading apparatus by replacing the recording head with a scanner which is configured like a recording head.

The scanner moves together with the carriage on the printer side to read the images on a source document which is carried in place of a recording medium. Then, it is arranged to read out the image information on one source document by alternately performing the operation of read and feed of the source document.

Figure 6B:
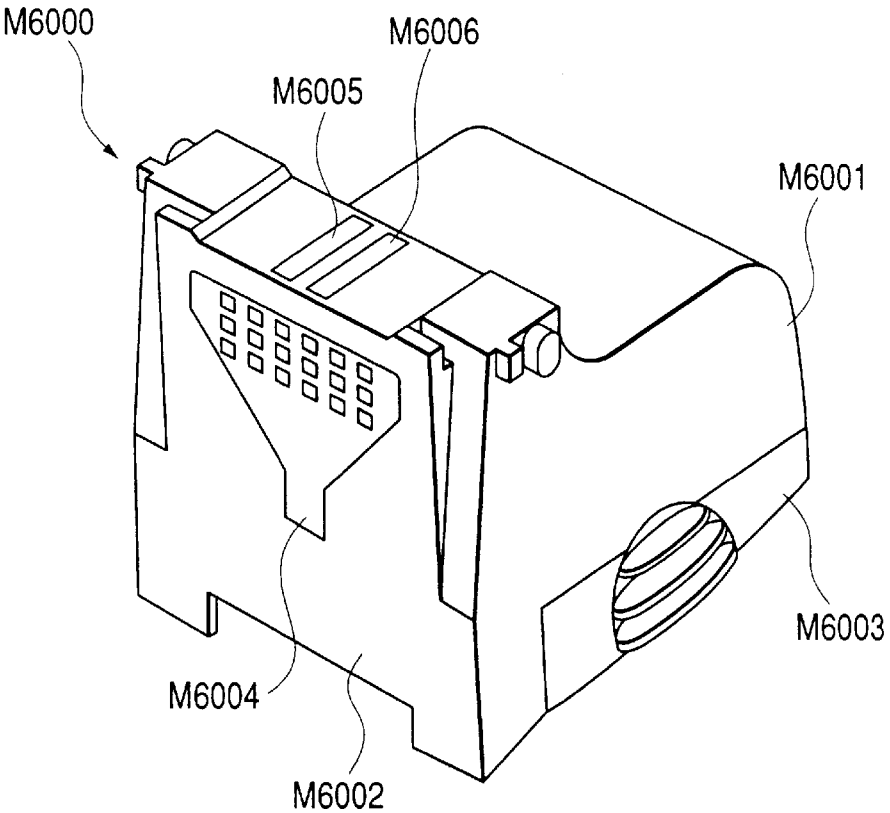
FIGS. 6A and 6B are perspective views which illustrate a scanner cartridge embodying the present invention.
Figure 6A:
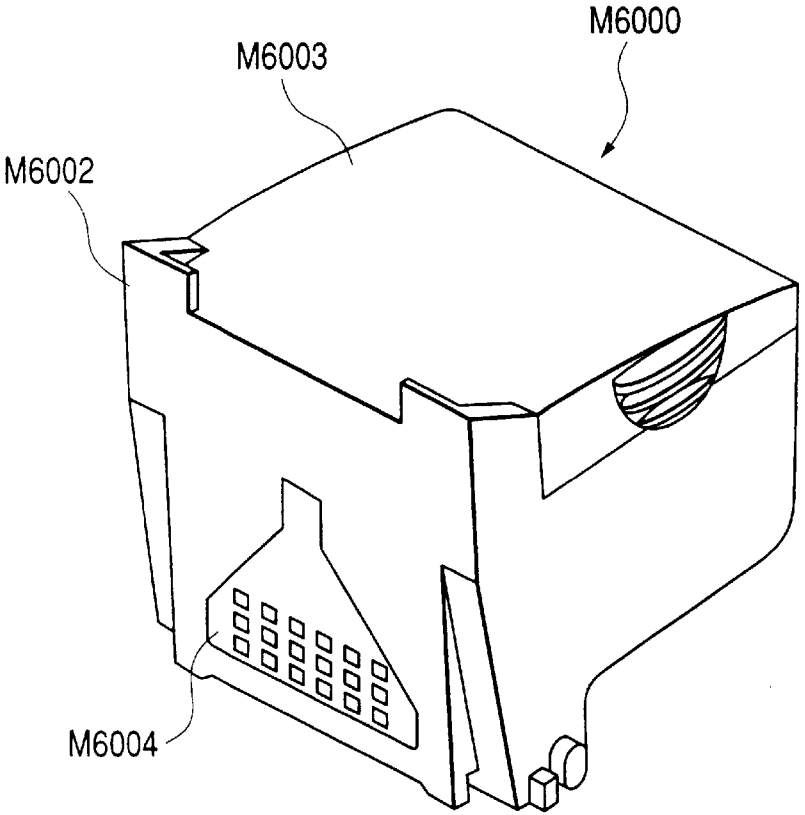

FIGS. 6A and 6B are views which schematically illustrate the structure of the scanner M6000.

As shown in FIGS. 6A and 6B, the scanner holder M6001 is of box type, in which the optical system and processing circuit are installed to effectuate reading as required. Also, a scanner reading lens M6006 is installed on the portion that faces the surface of a source document when the scanner M6000 is installed on the carriage M4001. The images of the source document are read through it. A scanner illumination lens M6005 is provided with a light source (not shown) inside the scanner to irradiate light emitted from the light source on the source document through it.

The scanner cover M6003 fixed to the bottom face of the scanner holder M6001 is fitted to the scanner holder M6001 to shield the interior thereof. Then, with the louver-like handles arranged on the side faces, it is intended to enhance the operability of the scanner M4001 for its attachment and detachment. The outer shape of the scanner holder M6001 is almost the same as that of the recording head H1001, which is detachably mountable on the carriage M4001 in the same manner as to handle the recording head cartridge H1000.

Also, for the scanner holder M6001, the base plate having the processing circuit provided therefor is incorporated, while the scanner contact PCB which is connected with this base plate is arranged to be exposed outside. Then, when the scanner M6000 is installed on the carriage M4001, the scanner contact PCB M6004 is in contact with the contact FPC E0011 on the carriage M4001 side, thus connecting the base plate with the control system on the main body side electrically through the carriage M4001.

Now, the description will be made of the structure of the electric circuit in accordance with the present embodiment of the invention.

Figure 7:
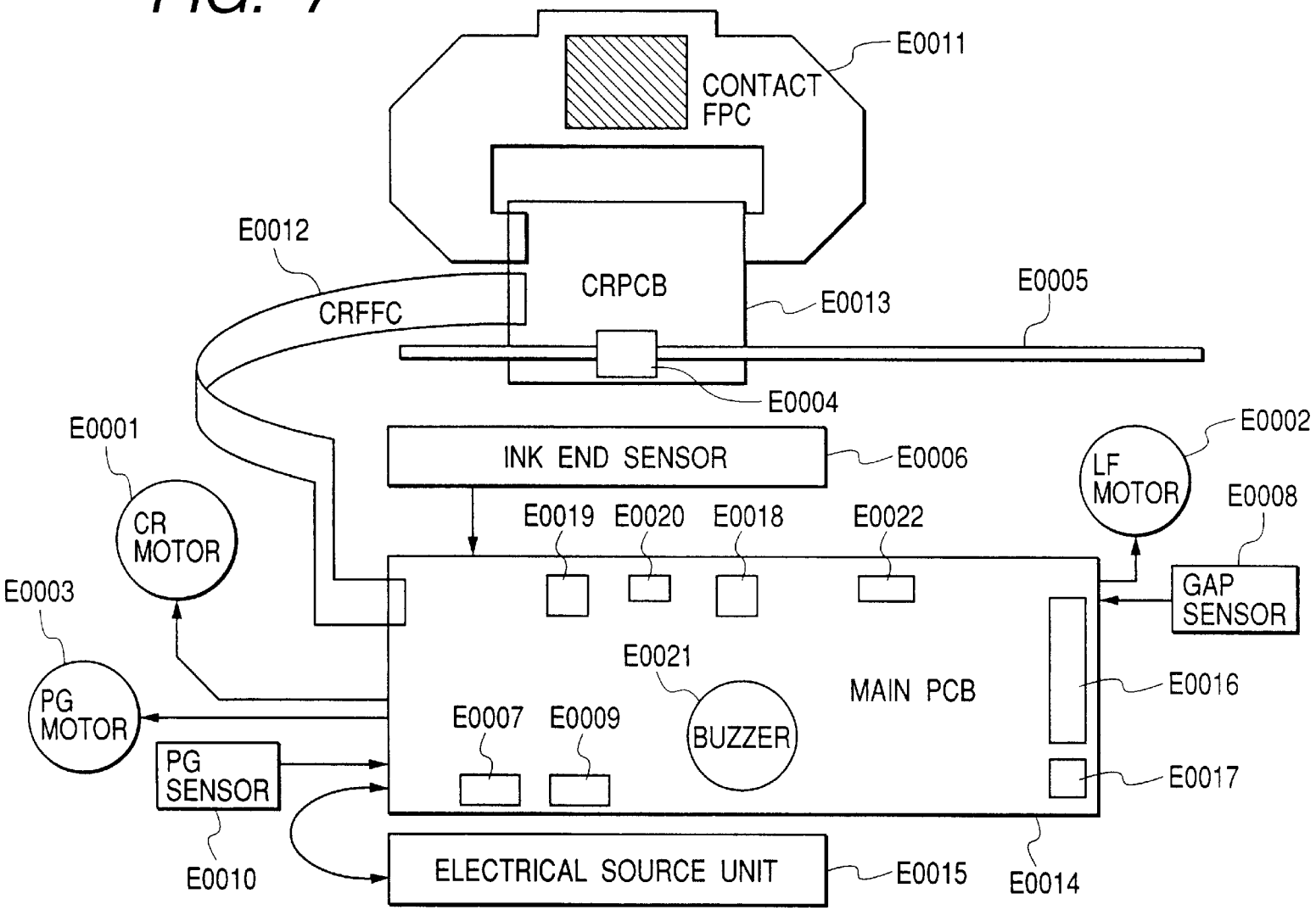
FIG. 7 is a block diagram which schematically shows the entire structure of the electric circuit embodying the present invention.

FIG. 7 is a view which schematically shows the entire structure of the electric circuit of the present embodiment.

The electric circuit here mainly comprises the carriage base plate (CRPCB) E0013, the main PCB (Printed Circuit Board) E0014, and the power source unit E0015, among some others.

In this respect, the power source unit is connected with the main PCB E0014 to supply various driving powers.

Also, the carriage base plate E0013 is a printed base plate unit mounted on the carriage M4001 (see FIG. 2), and functions as an interface to deal with signals from and to the recording head through the contact FPC E0011. Also, along with the movement of the carriage M4001, this unit detects the positional changes between the encoder scale E0005 and the encoder sensor E0004 in accordance with the pulse signals output from the encoder sensor E0004, and then, outputs the detected output signals to the main PCB E0014 through the flexible flat cable (CRFFC) E0012.

Further, the main PCB is a printed base plate unit that controls the driving of each unit of the ink jet recording apparatus of the present embodiment, which has I/O ports for a paper edge sensor (PE sensor) E0007; an ASF sensor E0009; a cover sensor E0022; a parallel interface (parallel I/F) E0016; a serial interface (serial I/F) E0017; a resume key E0019; an LED E0020; a power source key E0018; and a buzzer E0021, among some others. This PCB is also connected with the CR motor E0001, the LF motor E0002, and the PG motor E0003 to control driving each of them. Besides, it has a connecting interface with the ink end sensor E0006; the GAP sensor E0008; the PG sensor E0010; the CRFFC E0012; and the power source unit E0015.

Figures 8, 8A:
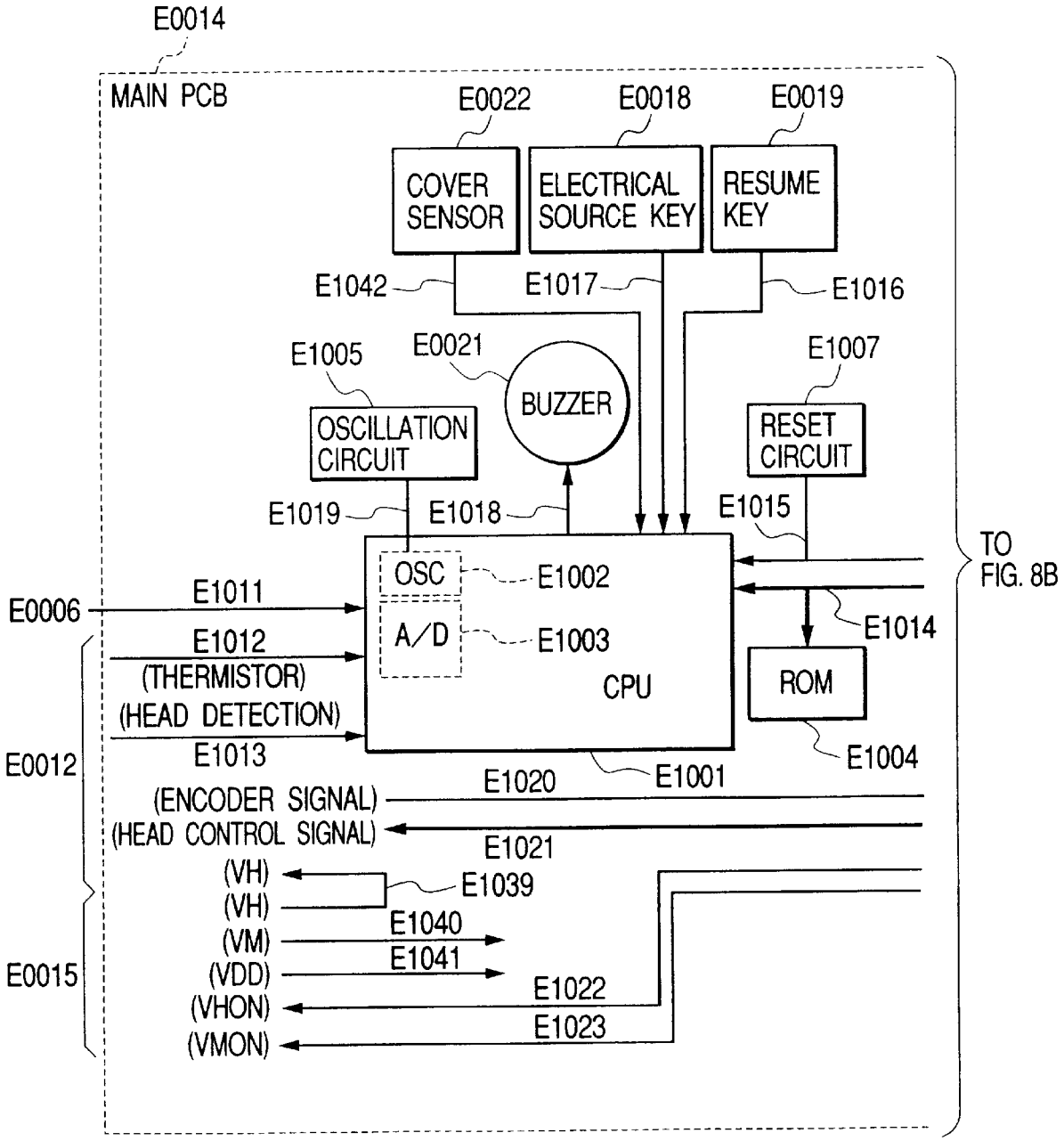
FIG. 8, composed of FIGS. 8A and 8B, is a block diagram which shows the inner structure of the main PCB represented in FIG. 7.
Figure 8B:
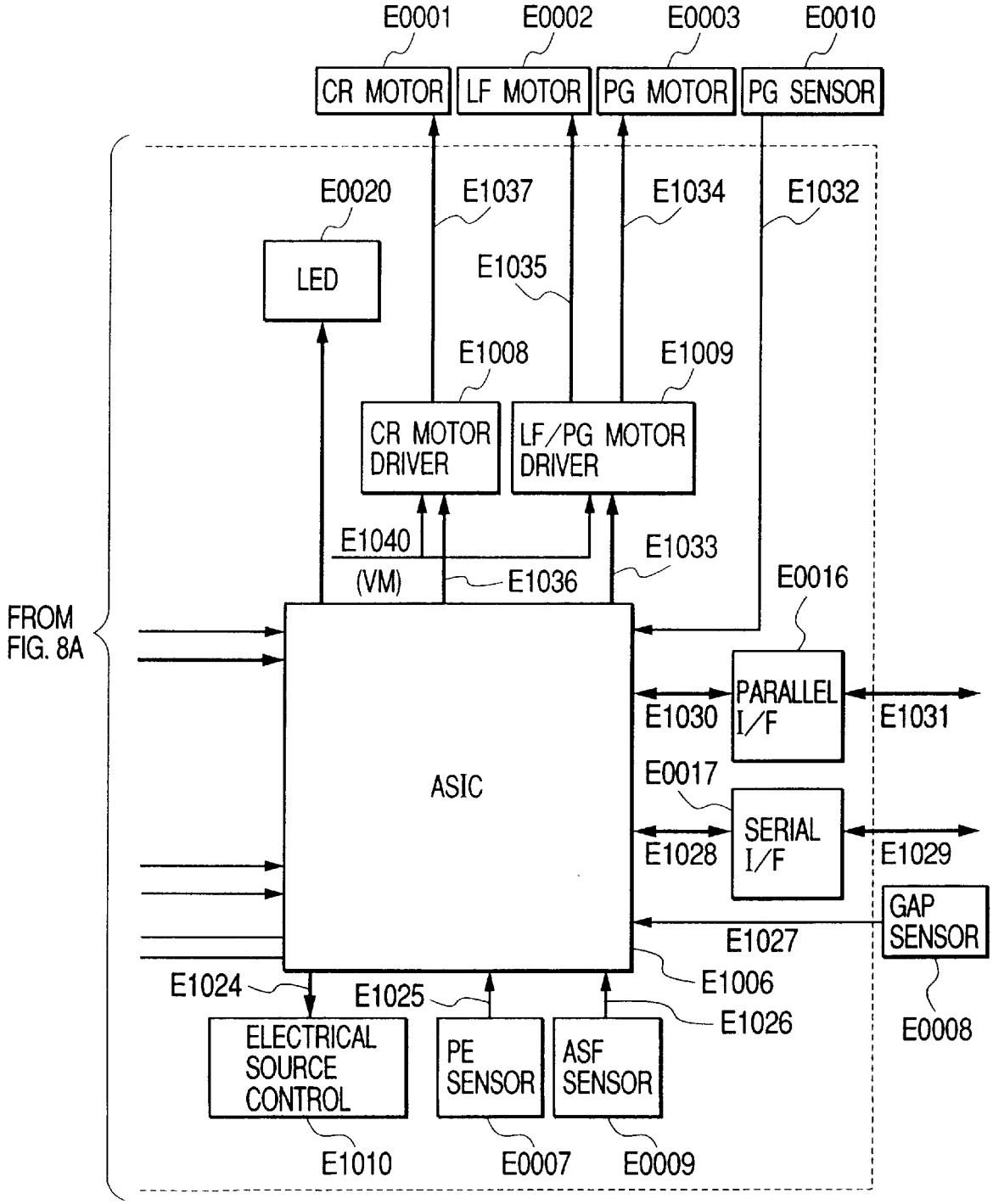

FIG. 8 is comprised of FIGS. 8A and 8B showing block diagrams which illustrate the inner structure of the main PCB.

In FIGS. 8A and 8B, a reference numeral E1001 designates a CPU. The CPU E1001 is provided with an oscillator OSC E1002, and at the same time, it is connected with the oscillating circuit E1005 to generate system clock with the output signals E1019 therefrom, and also, through the control bus E1014, it is connected with the ROM E1004 and the ASIC (Application Specific Integrated Circuit) E1006. Thus, in accordance with the program stored on the ROM, it controls the ASIC, and detects the input signals E1017 from the power source key; the input signals E1016 from the resume key, as well as the current status of the cover detection signal E1042 and the head detection signal (HSENS) E1013. Further, it sounds the buzzer E0021 in accordance with the buzzer signal (BUZ) E1018. Then, while detecting the current status of the ink end detection signal (INKS) E1011 and the thermistor temperature detection signal (TH) E1012, which are connected with the incorporated A/D converter E1003, it controls the driving of the ink jet recording apparatus by executing various logical operations required, as well as determining Å conditions or the like.

Here, the head detection signal E1013 is a head installation detecting signal which is inputted from the recording head cartridge H1000 through the flexible flat cable E0012, the carriage base plate E0013, and the contact flexible printed cable E0011. The ink end detection signal is an analogue signal output from the ink end sensor E0006. The thermistor temperature detection signal E1012 is an analogue signal output from a thermistor (not shown) installed on the carriage base plate E0013.

A reference numeral E1008 designates the CR motor driver which generates the CR motor driving signal E1037 with the motor power source (VM) E1040 as its driving power source and in accordance with the CR motor control signal E1036 output from the ASIC E1006, thus driving the CR motor E0001; E1009, the LF/PG motor driver which generates the LF motor driving signal E1035 with the motor power source E1040 as a driving power source, and in accordance with the pulse motor control signal (PM control signal) E1033 output from the ASIC E1006, thus driving the LF motor, at the same time, generating the PG motor driving signal E1034 to drive the PG motor.

A reference numeral E1010 designates the power source control circuit which controls power supply to each of the sensors or the like provided with the light emitting devices in accordance with the power source control signals E1024 output from the ASIC E1006. The parallel I/F E0016 transmits the parallel I/F signals E1030 output from the ASIC E1006 to the parallel I/F cable E1031 which is externally connected, and also, transmits the signals of the parallel I/F cable E1031 to the ASIC E1006. The serial I/F E0017 transmits the serial I/F signals E1028 output from the ASIC E1006 to the serial I/F cable E1029 externally connected, and also, transmits the signals from the cable E1029 to the ASIC E1006.

On the other hand, the head power source (VH) E1039, the motor power source (VM) E1040, and the logic power sour (VDD) E1041 are supplied from the power source unit E0015. Also, from the ASIC E1006, the head power source ON signal (VHON) E1022, the motor power source ON signal (VMOM) E1023 are inputted into the power source unit E0015, thus controlling the ON/OFF of the head power source E1039 and the motor power source E1040, respectively. The logic power source (VDD) E1041 supplied from the power source unit E0015 is given a voltage transformation as required, and then, supplied to each of the internal and external units of the main PCB E0014.

Also, the head power source E1039 is smoothed on the main PCB E0014, and then, to be transmitted to the flexible flat cable E0011 for driving the recording head cartridge H1000.

A reference numeral E1007 designates the resetting circuit to detect the drop of the logic power source voltage E1040, and supplies a resetting signal (RESET) E1015 to the CPU E1001 and the ASIC E1006 to perform initialization.

The ASIC E1006 is one-chip semiconductor integrated circuit, which is controlled by the CPU E1001 through the control bus E1014, and outputs the CR motor control signal E1036, the PM control signal E1033, the power source control signal E1024, the head power source ON signal E1022, and the motor power source ON signal E1023, among some others, and also, perform the transmission and reception of signals through the parallel I/F E0016 and the serial I/F E0017. Besides, it detects the status of the PE detection signal (PES) E1025 from the PE sensor E0007; the ASF detection signal (ASFS) E1026 from the ASF sensor E0009; the GAP detection signal (GAPS) E1027 from the GAP sensor E0008; and the PG detection signal (PGS) E1032 from the PG sensor E0007, and then, transmits the data on each of them to the CPU E1001 through the control bus E1014. The CPU E1001 controls the LED driving signals E1038 to turn on and off the LED E0020 accordingly.

Further, the condition of the encoder signal (ENC) E1020 is detected to generate the timing signals, and the recording head cartridge H1000 is interfaced by use of the head control signals E1021 to control the recording operation. Here, the encoder signals (ENC) E1020 are the output signals from the CR encoder sensor E0004, which are inputted through the flexible flat cable E0012. Also, the head control signals E1021 are supplied to the recording head H1000 through the flexible flat cable E0012, the carriage base plate E0013, and the control FPC E0011.

Figures 9, 9A:
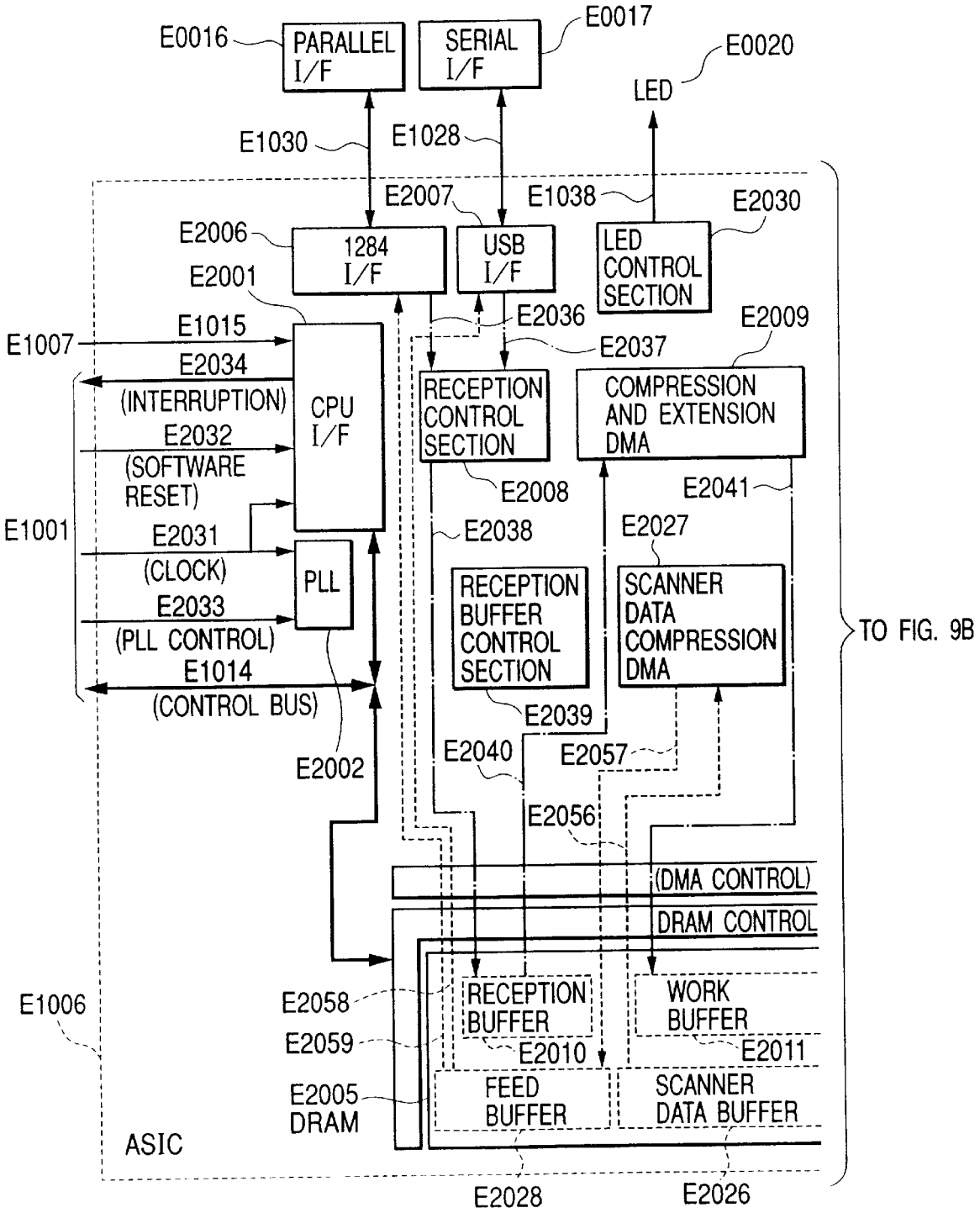
FIG. 9, composed of FIGS. 9A, 9B and 9C, is a block diagram which shows the inner structure of the ASIC represented in FIGS. 8A and 8B.
Figure 9B:
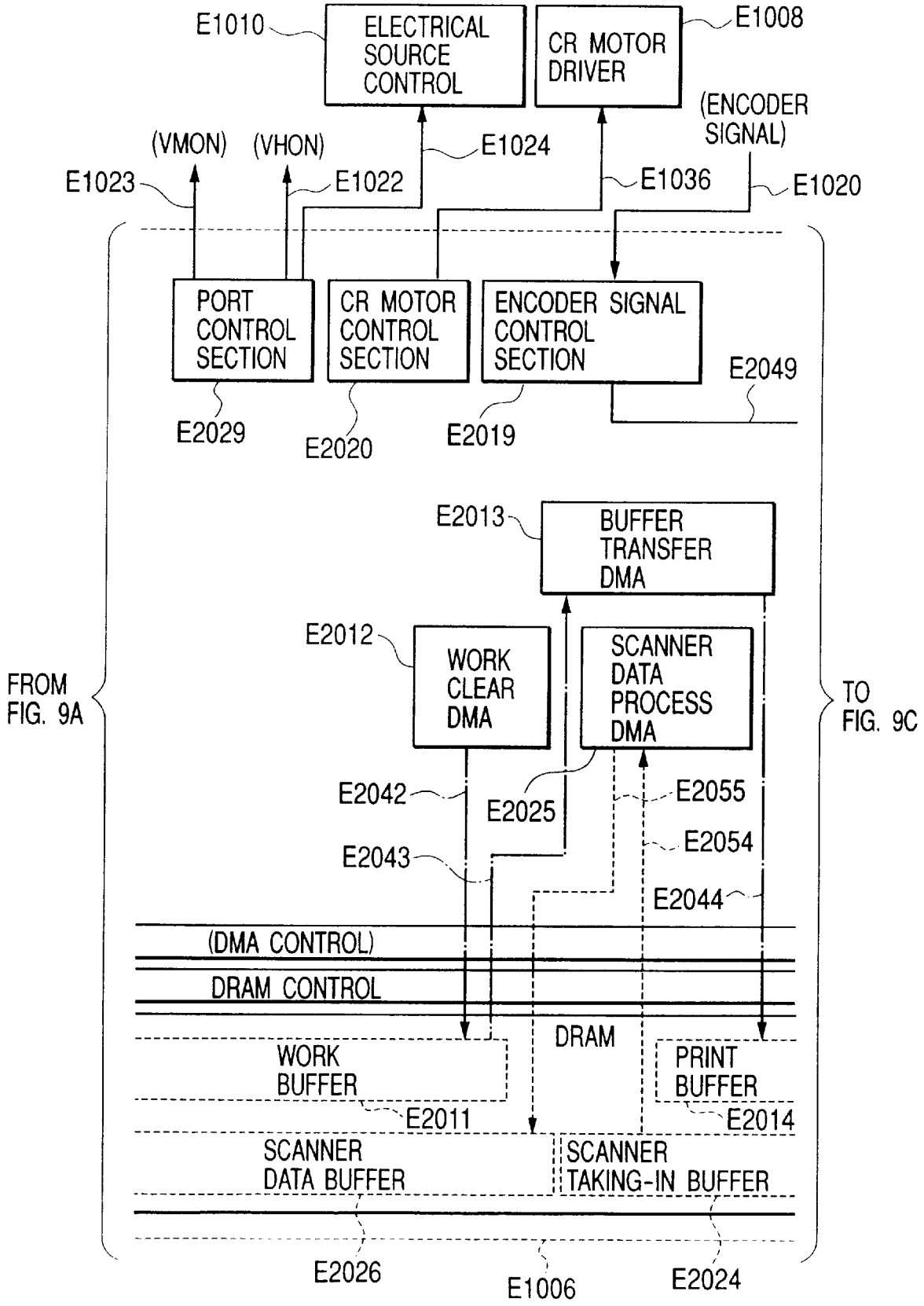
Figure 9C:
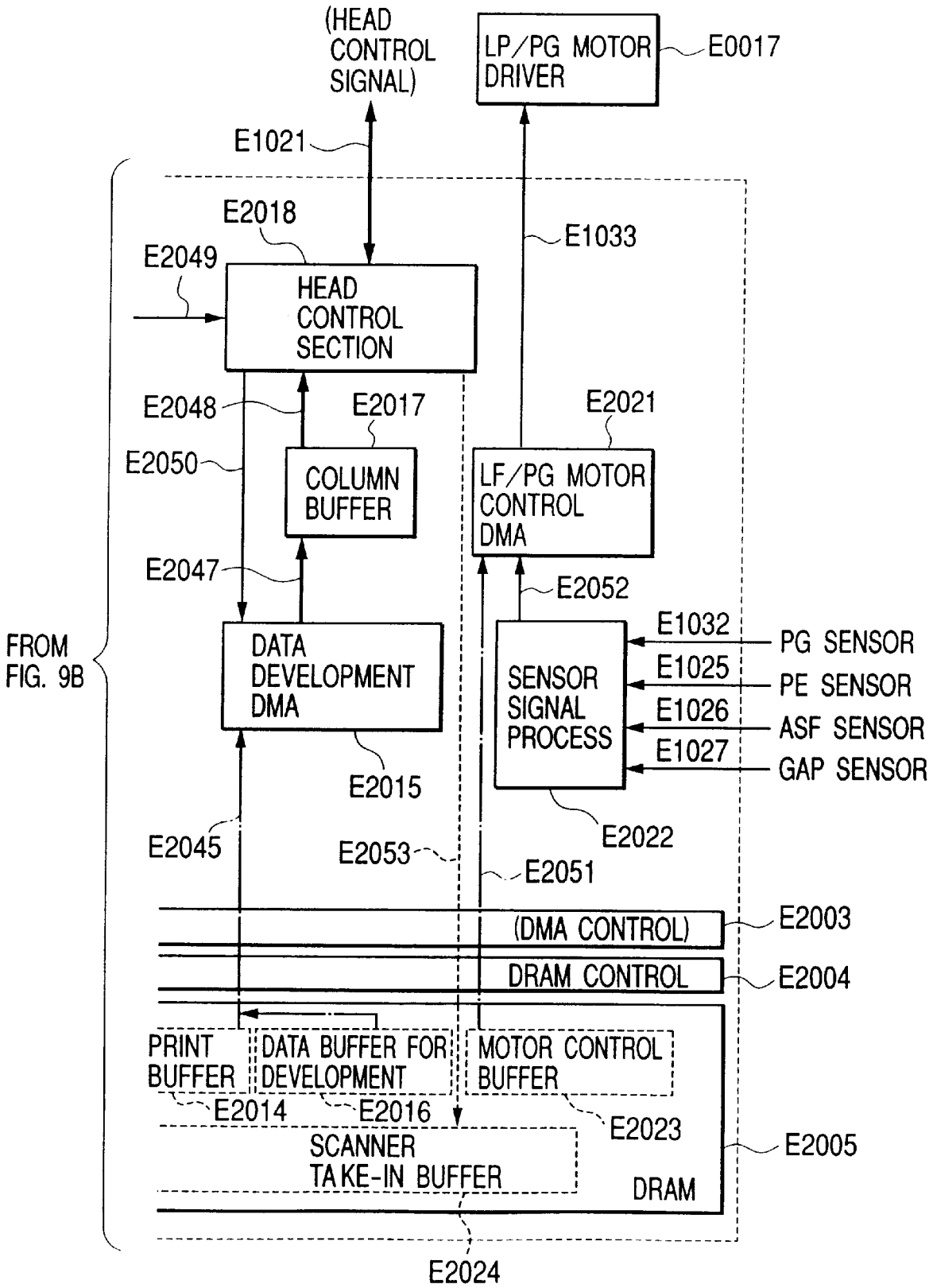

FIG. 9 is comprised of FIGS. 9A, 9B and 9C showing block diagrams which illustrate the inner structure of the ASIC E1006.

Here, in FIGS. 9A to 9C, the connection between each of the blocks indicates only the data flow related to the controls of each part of the head and various mechanisms, such as recording data, motor control data, among some others. The control signals which are related to the control signals and clocks required for reading from or writing to the registers incorporated in each of the blocks, and also, the one related to the DMA controls, among some others, are omitted in order to avoid complicated representation on FIGS. 9A to 9C.

In FIGS. 9A to 9C, a reference numeral E2002 designates PLL which generates clock (not shown) to be supplied to the major portions of the ASIC E1006 by use of the clock signals (CLK) E2031 output from the CPU E1001 as shown in FIGS. 9A to 9C, and the PLL control signal (PLLON) E2033.

Also, a reference numeral E2001 designates the CPU interface (CPU I/F), which controls reading from or writing to the registers of each block to be described below, supplies clocks to a part of blocks, and receives the interruption signals (none of them is shown), among some others, and then, outputs interruption signals (INT) E2034 to the CPU E1001 to notify the interruption occurring in the interior of the ASIC E1006 in accordance with the resetting signal E1015, the soft resetting signal (PDWN) E2032, the clock signals (CLK) E2301, and the control signals from the control bus E1014.

Also, a reference numeral E2005 designates the DRAM serving as the recording buffer, which is provided with each area for reception buffer E2010, work buffer E2011, printing buffer E2014, development buffer E2016, and the like, and at the same time, it is provided with the buffer E2023 for controlling motors. Further, as the buffer usable in the mode of scanner operation, it is provided each area for scanner fetch buffer E2024, scanner data buffer E2026, send-out buffer E2028, and the like in place of each of the recording data buffers.

Also, the DRAM E2005 is used as the work area needed for operating the CPU E1001, too. In other words, a reference numeral E2004 designates the DRAM control unit to control access to the DRAM E2005 from the CPU E1001 by use of the control bus, as well as to control reading from and writing to the DRAM E2005 by switching access from the DMA control unit E2003 to the DRAM E2005, which will be described later.

When receiving request (not shown) from each of blocks, the DMA control unit E2003 outputs to the RAM control unit the address signals or control signals (not shown) or writing data (E2038, E2041, E2044, E2053, E2055, and E2057) and others if a writing operation is requested, hence operating the DRAM access. Also, if reading is requested, it transmits the read-out data from the DRAM control unit E2004 (E2040, E2043, E2045, E2051, E2054, E2056, E2058, and E2059) to the block originating such request.

Also, a reference numeral E2006 designates the 1284 I/F which interfaces the operation of the bidirectional communications with the external host equipment (not shown) through the parallel I/F E0016 by the control of CPU E1001 by way of the CPU I/F E2001. Beside, it transfers reception data (PIF reception data E2036) from the parallel I/F E0016 to the reception control unit E2008 by means of the DMA process at the time of recording. It transfers the data stored on the send-out buffer E2028 on the DRAM E2005 (1284 transmission data (RDPIF) E2059) to the parallel I/F by means of the DMA process at the time of scanner operation.

A reference numeral E2007 designates the USB I/F, which controls the CPU E1001 through the CPU I/F E2001 to interface the operation for the bidirectional communications with the external host equipment (not shown) through the serial I/F E0017. Besides, it transfers the reception data (USB reception data E2037) from the serial I/F E0017 to the reception control unit E2008 by means of the DMA process at the time of printing. It transmits the data stored on the send-out buffer E2028 on the DRAM E2005 (USB transmission data (RDUSB) E2058) to the serial I/F E0017 by means of the DMA process at the time of scanner reading operation. The reception control unit E2008 writes the reception data (WDIF) E2038 on the I/F selected either from 1284 I/F E2006 or the USB I/F E2007 to the reception buffer writing addresses which are controlled by the reception buffer control unit E2039.

A reference numeral E2009 designates the compression and expansion DMA, which reads the reception data (raster data) stored on the reception buffer E2010 from the reception buffer read-out addresses control be the reception buffer control unit E2039 by the control of CPU E1001 through the CPU I/F E2001, and then, compresses or expands such data (RDWK) E2040 depending on the designated mode, and writes them on the work buffer area as the recording code array (WDWK) E2041.

A reference numeral E2013 designates the recording buffer transmission DMA, which reads out the recording codes (RDWP) E2043 on the work buffer E2011 by the control of the CPU E1007 through the CPU I/F E2001. Then, it rearranges each of the recording codes for the addresses on the printing buffer E2014 to be suitable for the order of data transfer to the recording head cartridge H1000 for the execution of transfer (WDWP E2044). Also, a reference numeral E2012 designates the work clear DMA, which writes repeatedly the designated work file data (WDWF) E2042 to the area on the work buffer where the transfer is completed by means of the recording buffer transfer DMA E2015 by the control of CPU E1001 through the CPU I/F E2001.

A reference numeral E2015 designates the recording data development DMA, which reads out the recording data rearranged and written on the printing buffer with the data development timing signals E2050 from the head control unit E2018 as trigger by the control of the CPU E1001 through the CPU I/F E2001, as well as the development data written on the development buffer E2016, and generates the developed recording data (RDHDG) E2045 and writes them on the column buffer E2017 as the column buffer writing data (WDHDG) E2047. Here, the column buffer E2017 is the SRAM which provisionally stores the transferring data (developed recording data) to the recording head cartridge H1000, and which is commonly controlled by both blocks by the handshake signals (not shown) of the recording data development DMA and the head control unit.

A reference numeral E2018 designates the head control unit which interfaces with the recording head cartridge H1000 or the scanner by the control of the CPU E1001 through the CPU I/F E2001. Besides, it outputs the data development timing signals E2050 to the recording data development DMA in accordance with the head driving timing signals E2049 from the encoder signal processing unit E2019.

Also, at the time of printing, it reads out the developed recording data (RDHD) E2048 form the column buffer in accordance with the head driving timing signals E2049, and outputs the data to the recording head cartridge H1000 with the head control signals E1021.

Also, in the scanner reading mode, the DMA transfer is executed to transfer the fetched data (WDHD) E2053, which is inputted through the head control signals E1021, to the scanner fetching buffer E2024 on the DRAM E2005. A reference numeral E2025 designates the scanner data processing DMA, which reads out the fetched buffer reading data (RDAV) E2054 accumulated on the scanner fetching buffer E2024 by the control of the CPU E1001 through the CPU I/F E2001, and then, writes the processed data (WDAV) E2055, which are processed by averaging or the like, to the scanner data buffer E2026 on the DRAM E2005.

A reference numeral E2027 designates the scanner data compression DMA, which reads out the processed data (RDYC) E2056 on the scanner data buffer E2026 by the control of the CPU E1001 through the CPU I/F E2001 to compress data, and then, writes and transfers the compressed data (WDYC) E2057 to the send-out buffer E2028.

A reference numeral E2019 designates the encoder signal processing unit, which receives the encoder signals (ENC) and outputs the head driving timing signals E2049 in accordance with the mode specified by the control of the CPU E1001. Besides, it stores on the resister the information regarding the position and speed of the carriage M4001 obtainable by the encoder signals E1020, which are provided for the CPU E1001. On the basis of the information thus provided, the CPU E1001 determines various parameters to control the CR motor E0001. Also, a reference numeral E2020 designates the CR motor control unit, which outputs the CR motor control signals E1036 by the control of the CPU E1001 through the CPU I/F E2001.

A reference numeral E2022 designates the sensor signal processing unit, which receives various detection signals output from the PG sensor E0010, the PE sensor E0007, the ASF sensor E0009, and the GAP sensor E0008, among some others, and then, transfers these pieces of sensor information to the CPU E1001 in accordance with the mode specified by the control of the CPU E1001. Besides, it outputs the sensor detection signal E2052 to the LF/PG motor control unit DMA E2021.

The LF/PG motor control DMA E2021 reads out the pulse motor driving table (RDPM) E2051 from the motor control buffer E2023 on the DRAM E2005 by the control of the CPU E1001 through the CPU I/F E2001, and outputs the pulse motor control signals E. Besides, it outputs the pulse motor control signals E1033 as trigger to control the sensor detection signals depending on the operational mode.

Also, a reference numeral E2030 designates the LED control unit, which outputs the LED driving signals E1038 by the control of the CPU E1001 through the CPU I/F E2001; further, E2029, the port control unit, which outputs the head power source ON signals E1022, the motor power source ON signal E1023, and the power source control signals E1024 by the control of the CPU E1001 through the CPU I/F E2001.

Figure 10:
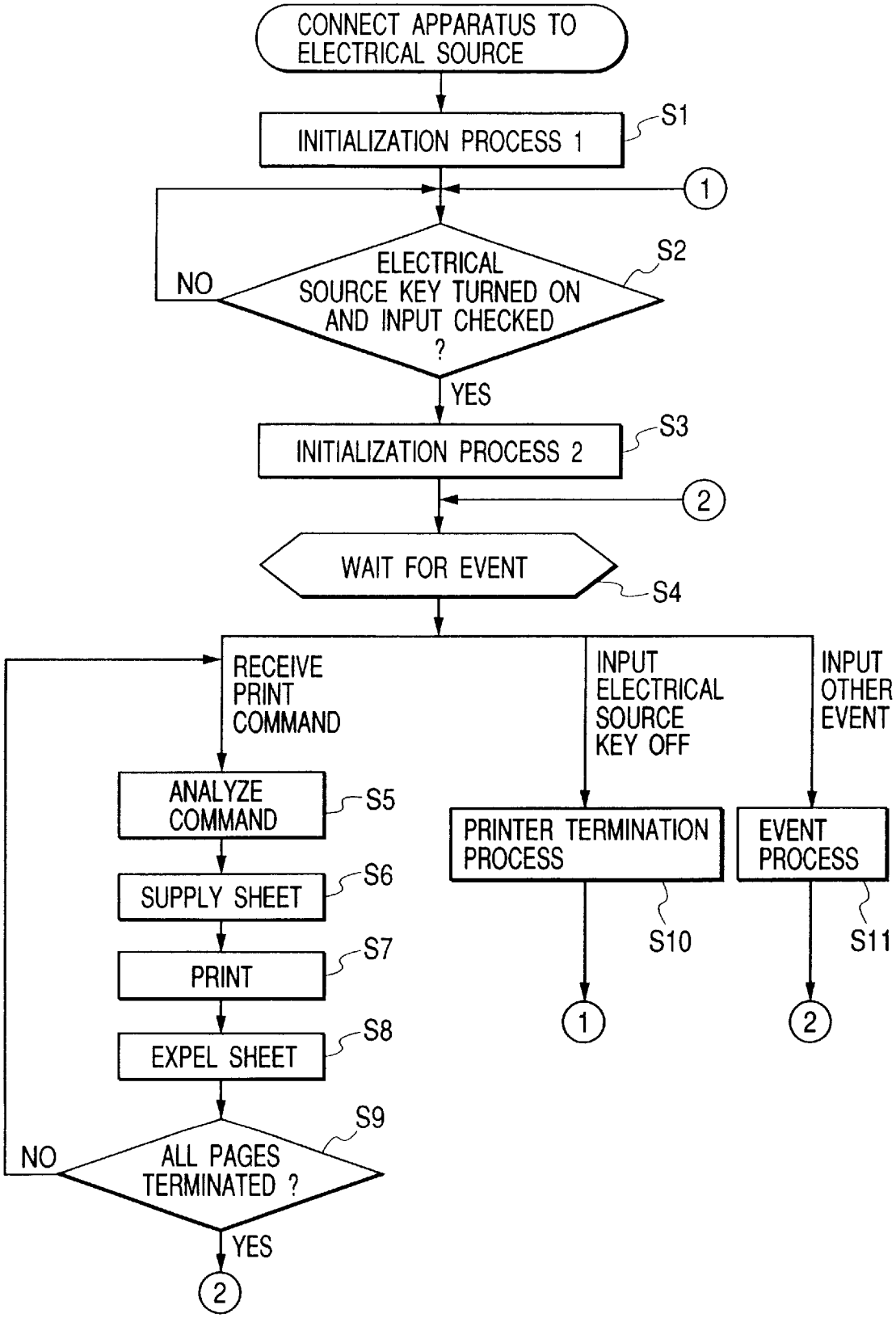
FIG. 10 is a flowchart which shows the operation in accordance with the embodiment of the present invention.

Now, in accordance with the flowchart shown in FIG. 10, the description will be made of the operation of an ink jet recording apparatus structured as described above, which embodies the present invention.

At first, in step S1, when the apparatus is connected with an AC power source, a first process of initialization is executed for the apparatus. In this initialization process, the electric circuit system is examined to check the ROM, RAM, and others for the apparatus, thus confirming whether or not the apparatus can electrically operate normally.

Then, in step S2, whether or not the power source key E0018, which is installed on the upper case M1002 of the apparatus main body M1000, has been turned ON is determined. If the power source key E0018 is turned on, the process proceeds to step S3 where a second initialization process is executed.

In the second initialization process, various driving mechanisms and head system of the apparatus are examined. In other words, it is confirmed whether or not the apparatus is normally operable when various motors are initialized and the head information is read out.

Then, in step S4, the process waits for the occurrence of an event. In other words, while monitoring the instruction event that may be furnished from the external I/F for the apparatus, and the panel key event furnished by the user's operation, as well as the inner control events, the process proceeds to execute the corresponding step when any one of such events occurs.

For example, if a printing instruction event is received from the external I/F in the step S4, the process proceeds to step S5. If a power source key event occurs in the step S4 by the user's operation, the process proceeds to step S10. If any other events should occur in the step S4, the process proceeds to step S11.

Here, in the step S5, the printing instruction from the external I/F is analyzed to determine the designated kind of paper, size of the paper sheet, print quality, feeding method, and some others. Then, the data that carries the results of such determination are stored on RAM E2005 in the apparatus main body, and the process proceeds to step S6.

Then, in the step S6, the paper feed is initiated by the paper feeding method designated in the step S5, and the paper sheet is carried to the record starting position. Thus, the process proceeds to step S7.

In the step S7, recording is performed. In this recording operation, the recording data, which have been transferred by way of the external I/F, are provisionally stored on the recording buffer. Then, the CR motor E0001 is driven to initiate moving the carriage M4001 in the scanning direction, and at the same time, the recording data stored on the printing buffer E2014 are supplied to the recording head H1001 for recording one-line portion. When the recording data of the one-line portion are recorded completely, the LF motor E0002 is driven to rotate the LF roller M3001, thus carrying the paper sheet in the sub-scanning direction. After that, the aforesaid operations are repeatedly executed until the recording data of one-page portion, which are provided by way of the external I/F, are completely recorded, and then, the process proceeds to step S8.

In the step S8, the LF motor E0002 is driven to drive the sheet exhaust roller M2003 to repeat paper feeding until it is ascertained that the paper sheet has been sent out of the apparatus completely. With this, then, the paper sheet is completely exhausted onto the exhaust tray M1004*a*.

Then, in step S9, it is ascertained whether or not the recording operation is completed for all the pages to be recorded. If there are more pages to be recorded, the precess returns to the step S5 to repeat the operations in the step S5 to the step S9. When the recording operation on all the designated pages is completed, the recording operation terminates, and the process proceeds to step S4 where it waits for the next event.

Meanwhile, in step S10, the printer finish process is carried out to suspend the operation of the apparatus. In other words, the power source is conditioned to be turned off. Then, after having turned off the power source, the process proceeds to the step S4 where it waits for the next event.

Also, in step S11, the events other than those described above are processed. For example, a process is executed for a recovery instruction from various panel keys of the apparatus or from the external I/F or for a recovery event occurring inside the apparatus itself, among some others. In this respect, after such instruction is completely executed, the process proceeds to the step S4 where it waits for the next event.

Now, the description will be made further in detail of the specific structure of the recording head H1001 described above, which serves as a liquid discharge head in accordance with the present invention.

Figure 11:
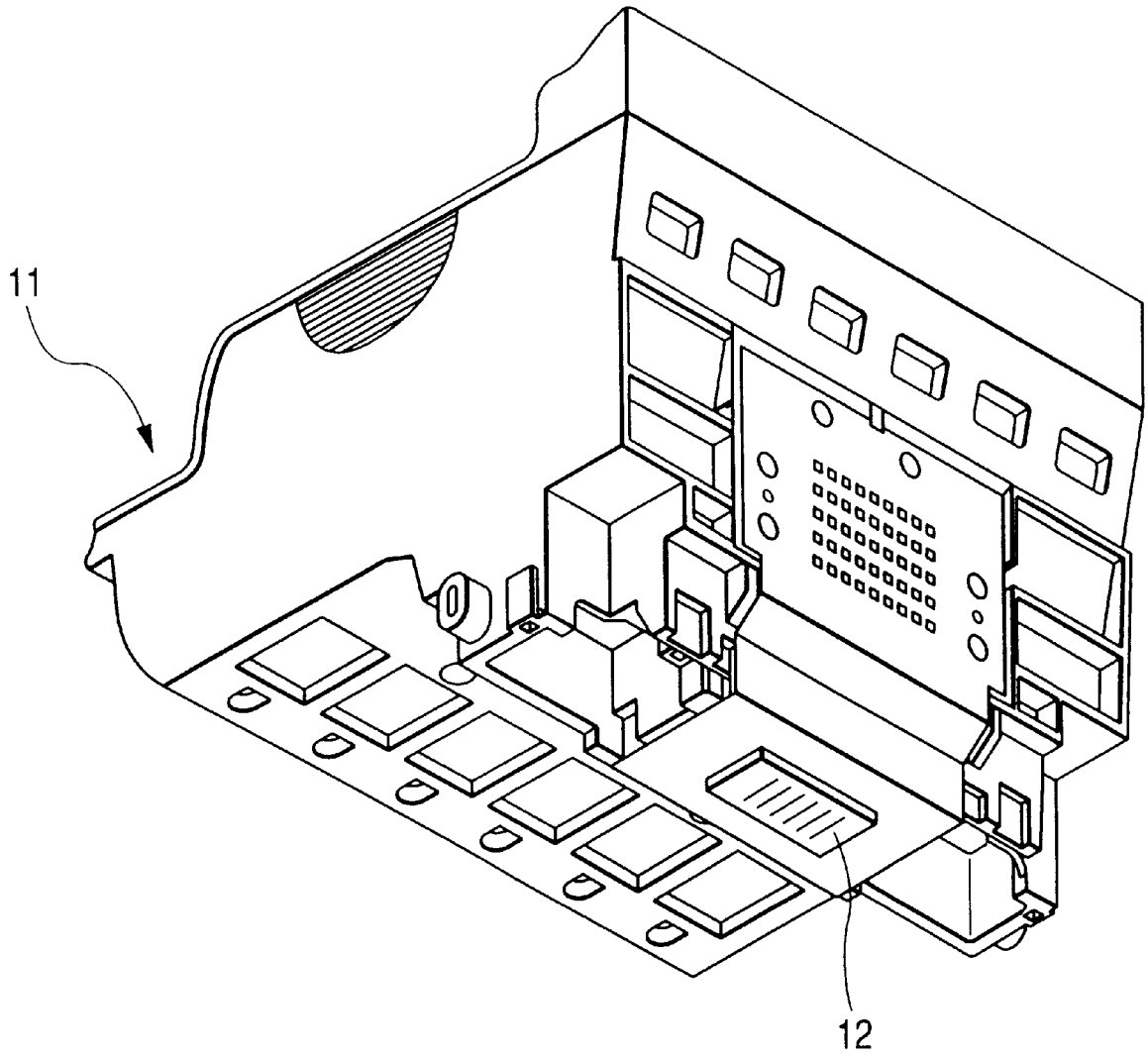
FIG. 11 is a perspective view which shows the external appearance of one embodiment for which the liquid discharge head of the present invention is applied to an ink jet head.
Figure 12A:
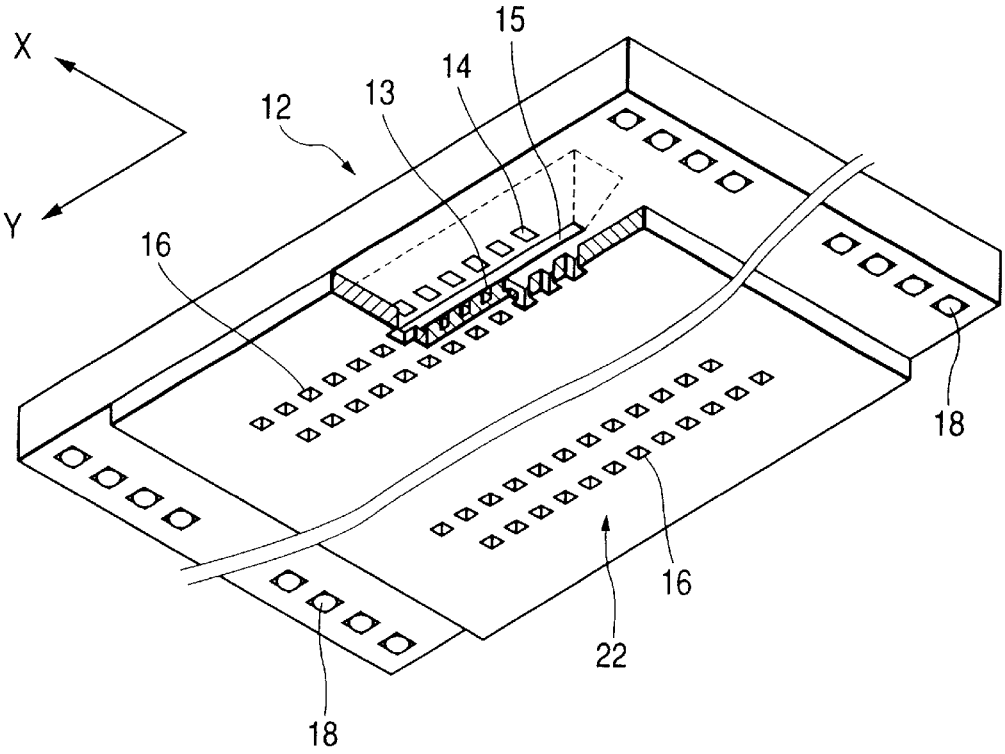
FIG. 12A is a perspective view which shows the external appearance of the heat generating base plate in accordance with the embodiment represented in FIG. 11, which is illustrated in a broken state here.
Figure 12B:
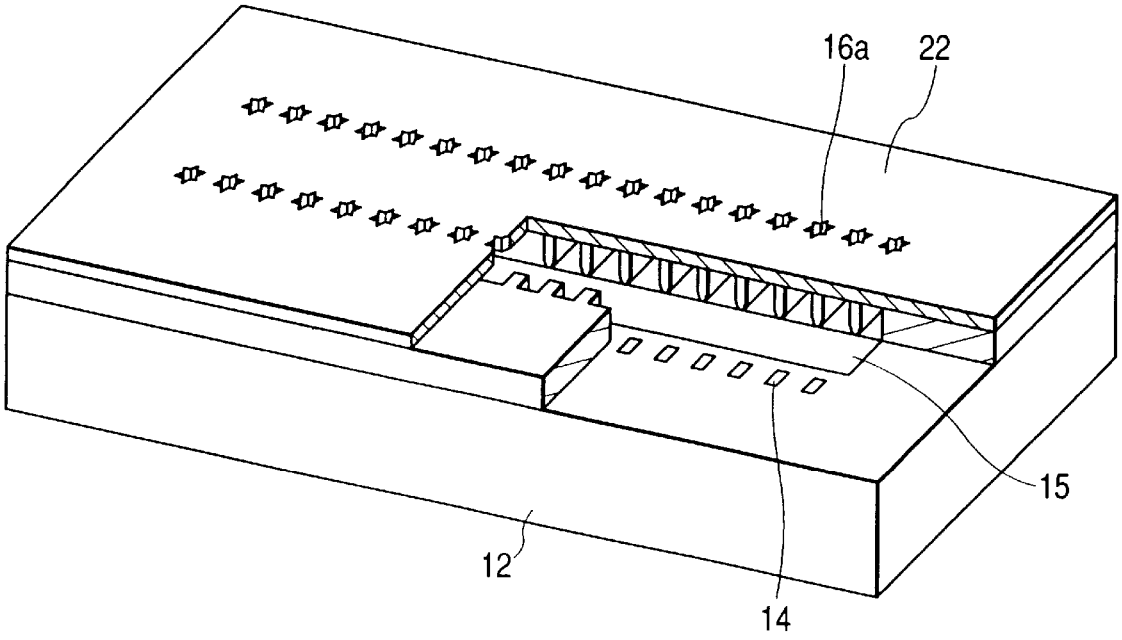
FIG. 12B is a partially broken perspective view which shows another embodiment of the heat generating base plate.
Figure 13:
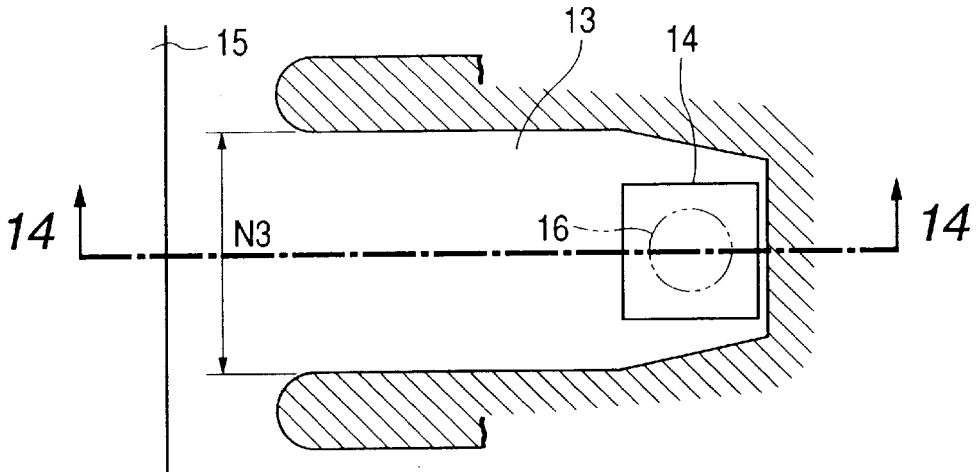
FIG. 13 is a sectional view which shows one ink chamber portion in accordance with the embodiment represented in FIG. 11.
Figure 14:
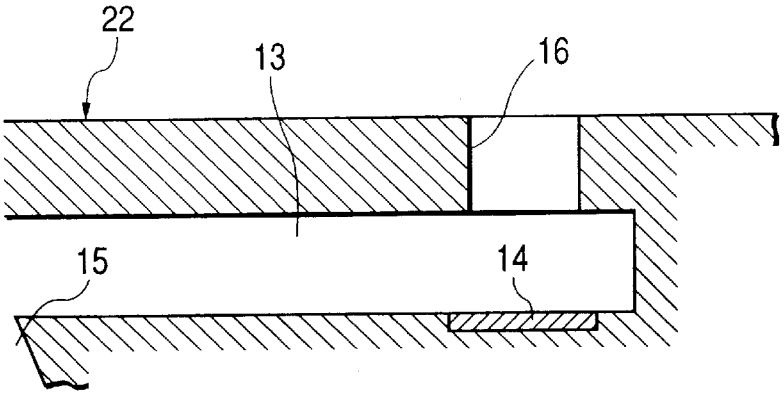
FIG. 14 is a cross-sectional view taken along line 14—14 indicated by arrows in FIG. 13.
Figure 15:
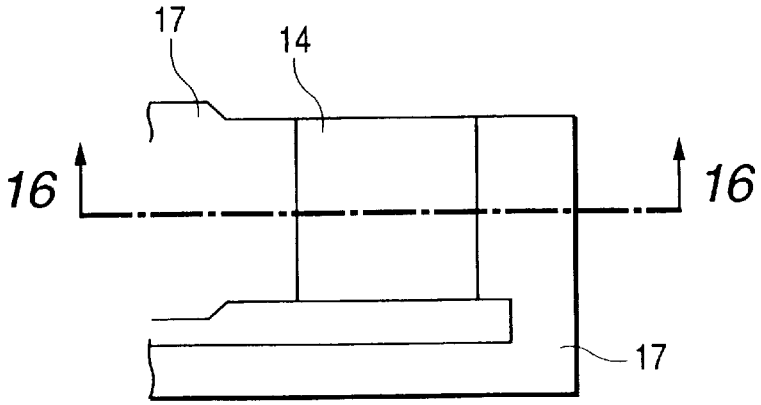
FIG. 15 is a plan view which shows the portion of an electrothermal transducing element in accordance with the embodiment represented in FIG. 11.
Figure 16:
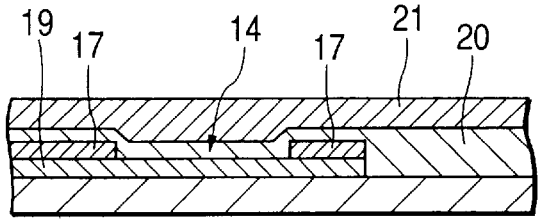
FIG. 16 is a cross-sectional view taken along line 16—16 indicated by arrows in FIG. 15.

FIG. 11 is a view which shows the outer appearance of an ink jet head 11, that is, the recording head H1001 in accordance with the present embodiment. FIG. 12A and FIG. 12B are broken sectional views which illustrate the heat generating base plate 12 serving as the recording elemental base plate H1100. FIG. 13 shows the inner structure of one of the ink chambers 13, and FIG. 14 shows the structural section taken along line 14—14 indicated by arrows in it. FIG. 15 is an extracted and enlarged view which shows a portion of the electrothermal transducing element 14, and FIG. 16 is a cross-sectional view taken along line 16—16 indicated by arrows in it. In other words, the heat generating base plate 12 is manufactured using Si wafer of 0.51 mm thick, for example, and the six thin and long ink supply ports 15 (H1201), which are arranged to be in parallel to each other, are formed corresponding to the six colors to be used by this ink jet head 11.

For each of the ink supply ports 15, two lines of ink chambers 13 are formed with the corresponding ink supply port 15 between them at predetermined intervals in the longitudinal direction of the ink supply ports 15. Then, for each of the ink chambers 13, the electrothermal transducing elements 14 are provided, and also, the discharge ports 16 (H1100T) for discharging ink droplets are arranged to face the electrothermal transducing elements 14, respectively.

In accordance with the present embodiment, the two lines of discharge ports 16, which are parallel to each other with the ink supply port 15 between them, are arranged in the so-called zigzag form where the discharge ports thus lined are displaced at half pitches from each other. Then, the ink chambers 13 corresponding to each line of the discharge ports 16 are arranged at intervals of 600 dpi, respectively. As a result, the intervals between the discharge ports 16 arranged in the longitudinal direction of the ink supply ports 15 are apparently in a state of being arranged in as high density as 1,200 dpi. Also, the electrode wiring 17 formed by the electrothermal transducing elements 14 and Al or the like, through which electric power is supplied to the electrothermal transducing elements 14, is formed on the surface of Si wafer by means of film formation technologies and techniques. The other end of the electrode wiring 17 is formed by Au or the like to configure the bumps 18 which are extruded from the surface of the heat generating base plate 12.

The electrothermal transducing element 14 of the present embodiment is a part of the heat resistive layer 19 formed by TaN, TaSiN, or Ta—Al, for example, which is not covered by the electrode wiring 17 formed Al or the like. This element has a sheet resistance value of 53Ω. Also, The electrothermal transducing elements 14 and the electrode wirings 17 are covered by a protection layer 20 formed SiN in a thickness of 4,000 Å. Further, a cavitation proof layer 21 formed by Ta is provided in a thickness of 2,300 Å by means of film formation for the surface of the protection layer 20 on the electrothermal transducing elements 14.

The ink supply ports 15 are formed by means of anisotropic etching by utilization of the crystalline orientation of the Si wafer which is used as the heat generating base plate 12. In other words, when the surface of the Si wafer is <100>, while the crystalline orientation of <111> is given in the thickness direction thereof, etching is carried out for a desired depth with the selectivity of etching directions using alkaline anisotropic etching solution, such as KOH, tetramethyl ammonium hydro-oxide (TMAH) or hydrazine. Also, Ink chambers 13 and discharge ports 16 are formed by use of photolithographic techniques. Then, with the electrothermal transducing element 14 being energized, an ink droplet of 4 picoliters is discharged from the discharge port 16.

In accordance with the embodiment described above, the discharge port 16 has a circular section. However, the discharge port may be in the form of a polygon, such as a rectangle or a star (shown at 16*a* in FIG. 12B).

Figure 17:
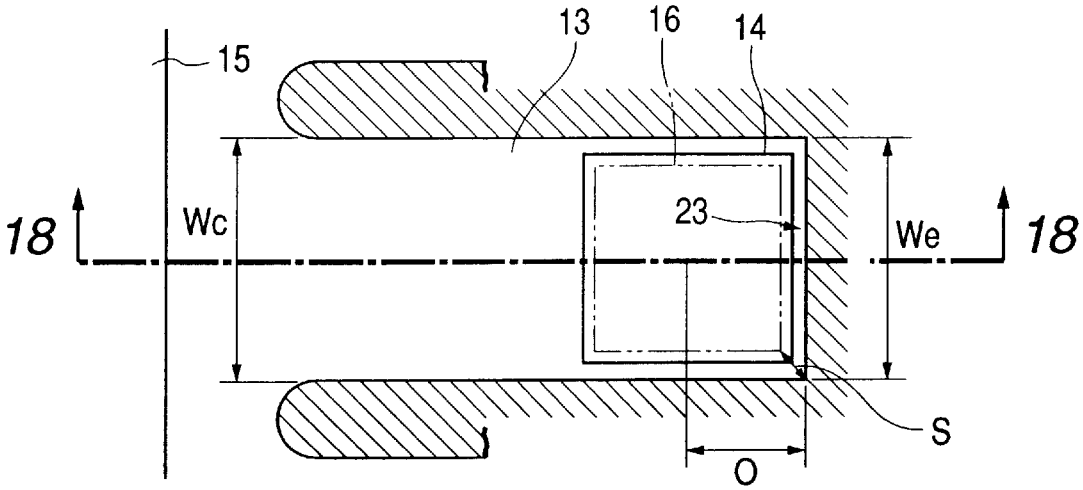
FIG. 17 is a cross-sectional view which shows the structure of the ink chamber of a liquid discharge head in accordance with another embodiment of the present invention.
Figure 18:
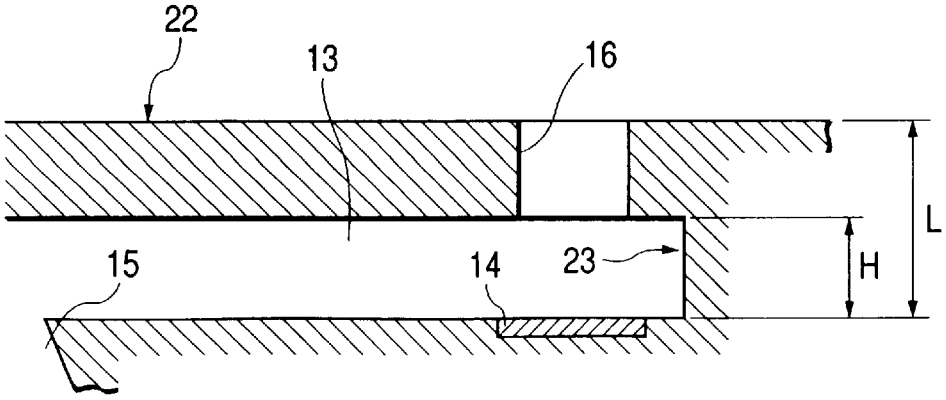
FIG. 18 is a cross-sectional view taken along line 18—18 indicated by arrows in FIG. 17.

FIG. 17 is a view which shows the structure of an ink chamber 13 portion of a liquid discharge head in accordance with another embodiment of the present invention described above, and FIG. 18 is a cross-sectional view which shows the structure thereof, taken along line 18—18 indicated by arrows in it. In this respect, the same reference marks are applied to the same functional members as those appearing in the previous embodiment. Any repetitive descriptions will be omitted. In other words, a rectangular discharge port 16 faces an electrothermal transducing element 14 configured to be a rectangle one side of which is 28 μm, and the discharge port 16 thus arranged is formed to face an ink chamber 13. One side of the discharge port 16 is set at 24 μm. The distance L, which is from the surface of the cavitation proof layer 21 (see FIG. 16) to the discharge port surface 22 where each of the discharge ports 16 are open, is 28 μm; the width Wc and the height H of the ink chamber 13 are 32 μm and 15 μm, respectively; and the width We of the edge wall 23 of the ink chamber 13 and the distance O from the edge wall 23 to the center of the electrothermal transducing element 14 are 30 μm and 15 μm, respectively.

Here, in accordance with the present embodiment, one side of the electrothermal transducing element 14 on the ink supply port 15 side is in agreement with the end portion of the ink chamber 15 having a specific width Wc, and at the same time, the centers of the electrothermal transducing element 14 and the discharge port 16 are in agreement with each other. Therefore, in the state shown in FIG. 17, the distance S, which is from one end portion of the edge wall 23 in the widthwise direction to the corner portion of the discharge port 16, is approximately 4.2 μm.

Figure 19:
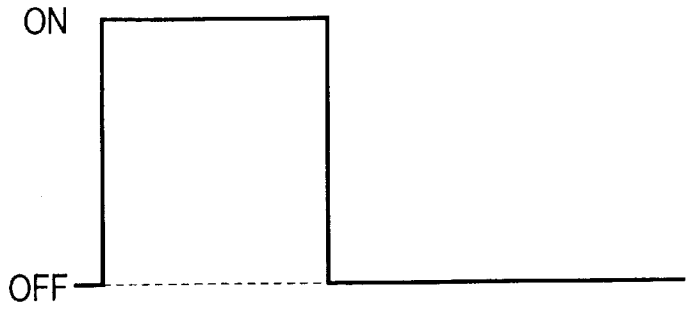
FIG. 19 is a waveform diagram which shows a single driving pulse applied to the electrothermal transducing element in accordance with the present invention.
Figure 20:
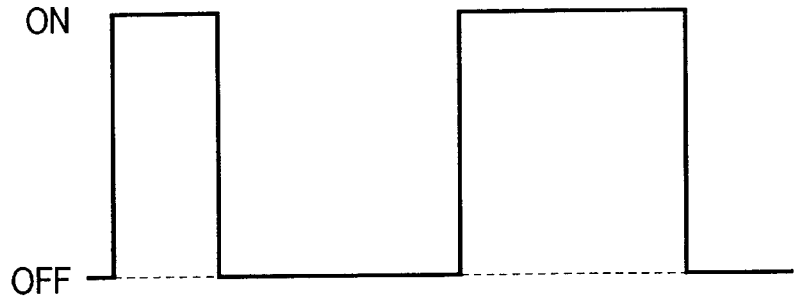
FIG. 20 is a waveform diagram which shows one example of the conventional driving pulses given to the electrothermal transducing element.

For the electrothermal transducing element 14, the driving frequency is 10 kHz, the driving voltage is 15.5V, and the driving pulse width is 1.0 μs so as to enable one discharge port 16 to perform discharging per approximately 100 μs at the minimum. Here, when one discharge port 16 discharges one main ink droplet, the electrothermal transducing element 14 is driven by a single rectangle driving pulse as shown in FIG. 19. If plural driving pulses are applied, as shown in FIG. 20, to the electrothermal transducing element 14 in order to let one discharge port 16 discharge one main ink droplet, the ink temperature rises in the vicinity of the electrothermal transducing element 14 by the driving pulse given for the first time. This tends to create the small bubble that may cause instable bubbling. The stability of bubbling is higher when driving is made by the application of a single driving pulse as shown in FIG. 19.

Figure 21:
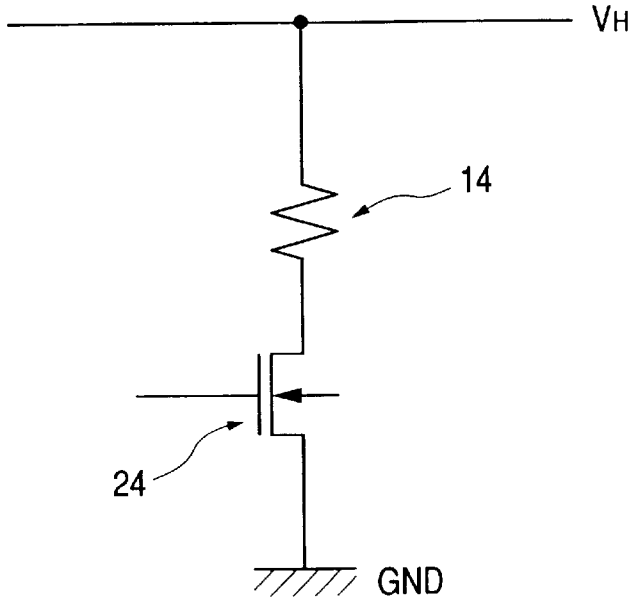
FIG. 21 is a driving circuit diagram which shows one example of driving means for the electrothermal transducing element in accordance with the present invention.

FIG. 21 is a view which shows the driving circuit of the electrothermal transducing element 14 in accordance with the present embodiment. Here, to the electrothermal transducing element 14, an NMOS type power transistor 24 is connected, which has a better switching characteristic than that of the bipolar type transistor with respect to the driving signals received by the ink jet head 11. The NMOS type power transistor 24 is incorporated on the heat generating base plate 12. It is possible for the NMOS type power transistor 24 to obtain the better switching characteristic than the bipolar type transistor, because the driving pulse width is as short as 1.0 μs for the present embodiment.

Also, for the present embodiment, ink having the following composition is supplied to the ink jet head 11:

| | |
|---|---|
| thiodiglycol | 5.0% |
| glycerin | 5.0% |
| urea | 5.0% |
| isopropyl alcohol | 4.0% |
| acetynol solution | 1.0% |
| direct blue 199 | 2.5% |
| water | remaining portion. |

The evaluated results of displacement accuracy and viscous plug properties of ink droplets, which are obtained by comparison between the embodiments and the comparative examples, are shown in the Table 1 given below.

TABLE 1

| | Embodiment 1 | Embodiment 2 | Embodiment 3 | Comparative Example 1 | Comparative Example 2 |
|---|---|---|---|---|---|
| Dimension of electrothermal transducing element (μm) | 28 × 28 | 28 × 28 | 28 × 28 | 28 × 28 | 28 × 28 |

TABLE 1-continued

| | Embodiment 1 | Embodiment 2 | Embodiment 3 | Comparative Example 1 | Comparative Example 2 |
|---|---|---|---|---|---|
| Distance L to discharge port surface (μm) | 28 | 34 | 28 | 38 | 28 |
| Film thickness of cavitation proof layer (Å) | 2300 | 2300 | 2300 | 2300 | 2300 |
| Film thickness of protection layer (Å) | 4000 | 4000 | 4000 | 4000 | 4000 |
| Driving voltage (V) | 15.5 | 15.5 | 20.0 | 15.5 | 11.0 |
| Driving pulse width (μs) | 1.0 | 1.0 | 0.6 | 1.0 | 2.0 |
| Ink droplet displacement accuracy (μm) | 4.1 | 3.9 | 3.8 | 3.8 | 6.5 |
| Ink viscous plug properties | Good | Good | Good | Bad | Good |
| Overall evaluation | Good | Good | Good | Bad | Bad |

For the embodiments and comparative examples shown in the Table 1, all the input energy for the electrothermal transducing element 14 is adjusted to be equal. More specifically, although the voltage applied to the terminals of the head are as per "driving voltage" shown in the Table 1, the voltages applied to the electrothermal transducing element 14 is 10.48V for the embodiments 1 and 2 and the comparative example 1, 7.44V for the comparative example 2, and 13.52V for the embodiment 3 because of the wiring resistance on the heat generating base plate 12, and the ON resistance of the NMOS type power transistor 24. As a result, all for the embodiments and comparative examples, the input energy is equally made 0.0027 ($\mu J/\mu m^2$) per unit area of the electrothermal transducing element 14.

The plane dimension of the ink chamber 13 of the comparative example 1 is the same as the other examples, but the distance L from the surface of the cavitation proof layer 21 to the discharge port surface 22 is made larger within the range of bubble being communicated with the air outside. If this distance L is simply made smaller, the deviation of discharge direction becomes greater due to the fluctuation of bubbling initiation time on the surface of the electrothermal transducing element 14. Thus, for the comparative example 2 for which the diving pulse width is set at 2 μs, the displacement accuracy of ink droplets is lowered than the other examples in the arrangement direction of the discharge ports 16.

On the other hand, the aforesaid distance L is 28 μm for the embodiments 1 to 3, but the displacement accuracy thereof is kept in good condition because the driving pulse width is set at 0.6 μs and 1.0 μs, respectively. If the driving pulse width is made smaller, it becomes possible to implement the enhancement of displacement accuracy by the stabilized bubbling. This becomes more effective when the distance L is set at 34 μm or less in particular.

In this respect, as shown in FIG. 15, it is preferable to set the direction in which the electrode wiring 17 extends in the direction orthogonal to the arrangement direction of the discharge ports 16 (in the left and right directions in FIG. 15). With this arrangement, even when the driving pulse width is as small as 1.2 μs, it becomes easier to raise the temperature of the electrothermal transducing elements 14 evenly in the arrangement direction of the discharge ports 16, which is orthogonal to the electrode wiring, thus improving the instability of displacement accuracy of ink droplets which may sometimes appear as the "white streaks" on a printing medium at the time of printing operation in the arrangement direction of the discharge ports 16.

As regards the ink viscous plug properties, it has been ascertained that the embodiments 1 to 3, and the comparative example 3 carry out printing operation normally. However, the comparative example 1 does not present normal result. Conceivably, this is because whereas the distance L is as large as 38 μm, the discharge speed of ink is lowered due to the driving pulse width which is as comparatively small as 1.0 μs, which makes it impossible to smoothly discharge the ink whose viscosity has increased in the area between the ink chamber 13 and the discharge port 16. Therefore, if the driving pulse width is at 1.2 μs or less, it is desirable to make the distance L 34 μm or less.

As clear from the aforesaid results, if the thickness of the covering layer on the electrothermal transducing element is 6,300 Å (the thickness of the SiN protection layer 20 being 4,000 Å), it becomes possible to enhance the displacement accuracy of ink droplets, while keeping the viscous plug properties of ink in good condition, by setting the distance L at 34 μm or less, and arranging the single driving pulse whose driving pulse width is as small as 0.6 μs to 1.0 μs.

In this respect, it is preferable to form both corners of the edge wall 23 of the ink chamber 13 at an obtuse angle, which facilitates a bubble to flow out better.

Figure 22:
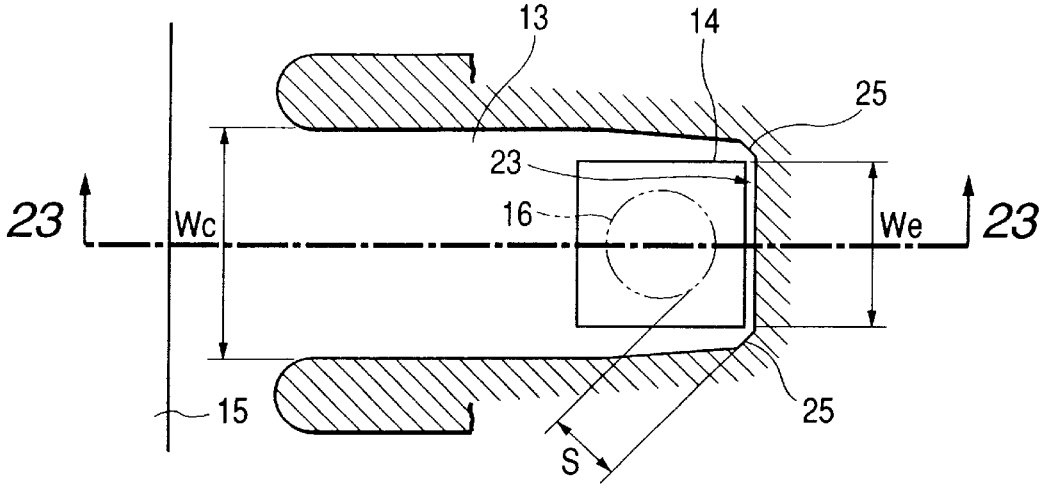
FIG. 22 is a cross-sectional view which shows the structure of the ink chamber of a liquid discharge head in accordance with a second embodiment of the present invention.
Figure 23:
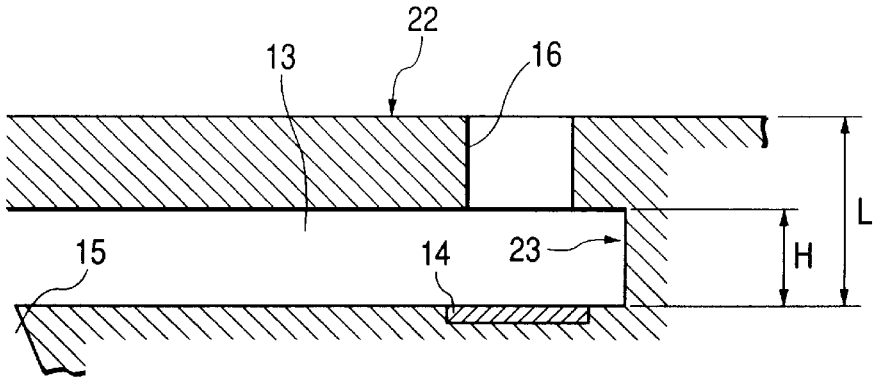
FIG. 23 is a cross-sectional view taken along line 23—23 indicated by arrows in FIG. 22.

FIG. 22 is a view which shows the plane structure of the ink chamber 13 portion in accordance with another embodiment of the present invention, and FIG. 23 is a cross-sectional view which shows this structure taken along line 23—23 in it. Here, the same reference marks are applied to the portions having the same functions as those of the previous embodiment, and any repetitive description will be omitted. In other words, the present embodiment makes it possible to operate printing at pitches of 1,200 dpi by use of an ink jet head 11 which scans in the direction orthogonal to the arrangement direction of the discharge ports 16.

The driving frequency of the electrothermal transducing element 14 is 15 kHz, and ink is discharged per approximately 67 μs at the minimum intervals for one circular discharge port 16 of 7.75 μm radius. For the electrothermal transducing element 14, Tan is used with a sheet resistive value of 53Ω. The protection layer 20 is formed by SiN in a film thickness of 2,000 Å or 3,000 Å. Also, the Ta cavitation proof layer 21 is formed in a film thickness of 1,000 Å or 2,300 Å.

The electrothermal transducing element 14 is a rectangle of 24×24 μm; the distance L from the surface of the cavitation proof layer 21 to the discharge port surface 22 is 27 μm; the width Wc of the ink chamber 13 and the height H thereof are 32 μm and 13 μm, respectively; and the width We of the edge wall 23 of the ink chamber 13 is 24 μm. The corners 25 of both end of the cul-de-sac edge wall 23 in the widthwise direction are chamfered each in 2 μm width and smoothly connected with each other. The distance S between the corners 25 and the circumferential edge of the discharge port 16 is approximately 8.8 μm. Then, with the discharge port 16 being circular, this distance is larger than that of the previous embodiment. All other dimensions are the same as those of the previous embodiment.

Also, the driving pulse of this ink jet head 11 is the single rectangular pulse the width of which is 0.6 μs or 1.2 μs.

As in the previous embodiment, the evaluation is made as to the displacement accuracy and viscous plug properties of ink droplets. The results are shown in the Table 2 given below. Unit and other details are the same as those in the previous case. The unit of input energy is μJ. The unit of the input energy per unit area of the electrothermal transducing element 14 is $\mu J/\mu m^2$.

For the comparative example 4 the film thickness of the covering layer is 10,300 Å (the film thickness of the protection layer 20 being 8,000 Å), the sum of film thickness of the cavitation proof layer 21 and that of the protection layer 20 is great, and as compared with the example where the protection layer 20 is made thinner, the input energy and input energy per unit area of the electrothermal transducing element 14, which are needed to enable it to reach the temperature at which ink is bubbled, are as high as 0.0037 $\mu J/\mu m^2$ as shown in the Table 2. Consequently, the temperature at which the electrothermal transducing element 14 itself arrives ultimately becomes higher than the temperature for the example having the protection layer 20 whose film thickness is thinner. Thus, the temperature of the protection layer 20 and the cavitation proof layer 21 in the vicinity of the electrothermal transducing element 14 are raised, and then, ink viscosity in the electrothermal transducing element 14 is made lower. Here, the electrothermal transducing element 14 is subjected to being affected easily by the steps or irregularities around it to make bubbling instable. As a result, there is a tendency that bubbling for use of discharges become instable. Conceivably, this causes the displacement accuracy not to be improved for the comparative example 4.

TABLE 2

| | Embodiment 4 | Embodiment 5 | Embodiment 6 | Embodiment 7 | Comparative Example 3 | Comparative Example 4 | Comparative Example 5 | Comparative Example 6 |
|---|---|---|---|---|---|---|---|---|
| Dimension of electrothermal transducing element (μm) | 24 × 24 | 24 × 24 | 24 × 24 | 24 × 24 | 24 × 24 | 24 × 24 | 24 × 24 | 24 × 24 |
| Distance L to discharge port surface (μm) | 27 | 27 | 27 | 27 | 27 | 27 | 27 | 36 |
| Film thickness of cavitation proof layer (Å) | 2300 | 2300 | 2300 | 1000 | 2300 | 2300 | 2300 | 2300 |
| Film thickness of protection layer (Å) | 3000 | 3000 | 4000 | 2000 | 4000 | 8000 | 3000 | 3000 |
| Input energy (μJ) | 1.26 | 1.26 | 1.43 | 0.88 | 1.43 | 2.11 | 1.26 | 1.26 |
| Input energy per unit area ($\mu J/\mu m^2$) | 0.0022 | 0.0022 | 0.0025 | 0.0013 | 0.0025 | 0.0037 | 0.0022 | 0.0022 |
| Driving voltage (V) | 11.0 | 15.5 | 11.7 | 9.2 | 9.0 | 14.3 | 8.5 | 11.0 |
| Driving pulse width (μs) | 1.2 | 0.6 | 1.2 | 1.2 | 2.0 | 1.2 | 2.0 | 1.2 |
| Ink droplet displacement accuracy (μm) | 4.1 | 3.8 | 4.0 | 3.9 | 6.9 | 6.9 | 6.5 | 4.0 |
| Presence of corner bubble | No | No | No | No | Yes | Yes | Yes | No |
| Unexpected non-discharge | None | None | None | None | Occurred | Occurred | Occurred | Occurred |
| Ink viscous plug properties | Good | Good | Good | Good | Good | Good | Good | Bad |
| Overall evaluation | Good | Good | Good | Good | Bad | Bad | Bad | Bad |

Studies are made with the driving pulses as parameters by changing the driving voltages applied to each of the ink jet heads 11. As in the embodiment 6 and the comparative example 3 where the film thickness of the covering layer is the same, it is arranged to make the input energy equal for the electrothermal transducing elements 14 by changing the driving voltage if the driving pulse width is different.

Figure 42:
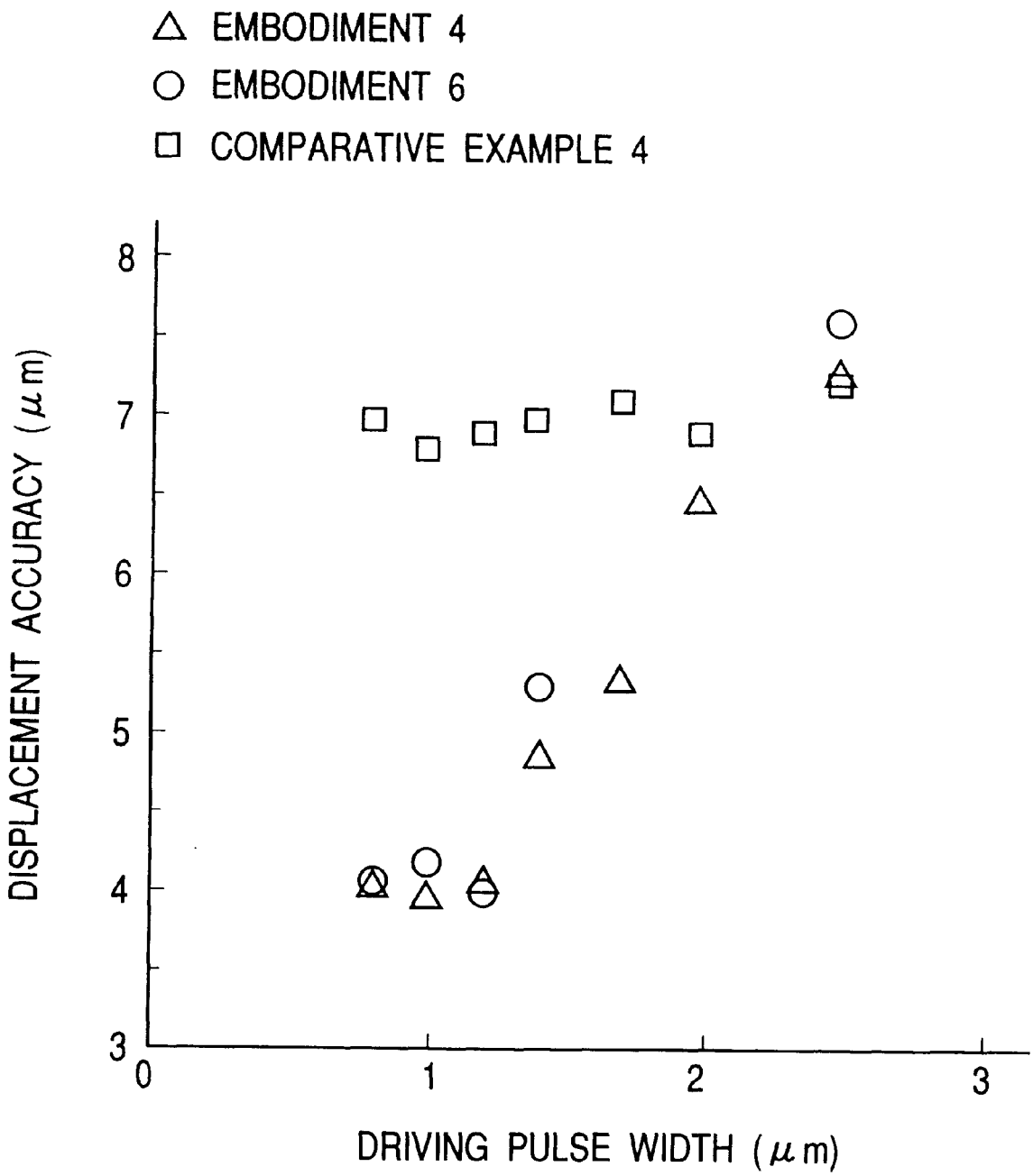
FIG. 42 is a graph which shows the relationship between the driving pulse width and the displacement accuracy of ink droplets in accordance with the fourth and sixth embodiments of the present invention and the fourth comparative example.

FIG. 42 is a graph which shows the relationship between the driving pulse widths for electrothermal transducing elements 14, and the displacement accuracies of ink droplets on a printing medium in the arrangement direction of discharge ports 16 for the embodiments 4 and 6, and the comparative example 4. In other words, for the comparative example 4 the film thickness of the covering layer of which is 10,300 Å (the film thickness of the protection layer 20 being 8,000 Å), the displacement accuracy is not improved even when the driving pulse width is made smaller. However, for the embodiment 4 and embodiment 6 the film thickness of covering layer of which is 5,300 Å or 6,300 Å (the film thickness of protection layer 20 being 3,000 Å or 4,000 Å), the displacement accuracies become better.

Here, as described earlier, it is preferable to set the direction in which the electrode wiring extends in the direction orthogonal to the arrangement direction of the discharge ports 16 (in the left and right directions in FIG. 15), because then the displacement accuracy of ink droplets is more enhanced in the arrangement direction of the discharge ports 16. Particularly with the driving pulse width being 1.2 μs or less, the displacement accuracy becomes more stabilized.

For the comparative examples 3 and 4, the corner bubbling is subjected to being easily created to make the liquid discharged instable. In contrast, no corner bubbling is created for the embodiment 4, and the resultant discharge of liquid is stabilized. In this way, the input energy per unit area of the electrothermal transducing element 14 is made 0.0027 $\mu J/\mu m^2$ or less, and ink is discharged by the application of the single pulse whose pulse width is 0.6 μs to 1.2 μs, thus eliminating the factors that bring the instable bubbling in the vicinity of the electrothermal transducing element 14 for the enhancement of displacement accuracy.

Also, for the embodiment described above, the thickness of the SiN protection layer 20 having high heat transferability is made smaller, but it may be possible to arrange the structure so that the film thickness of the Ta cavitation proof layer 21 is made smaller in order to discharge ink with the input energy of 0.0027 $\mu J/\mu m^2$ or less per unit area of the electrothermal transducing element 14. More specifically, even when the thickness of the covering layer is made 3,000 Å (the thickness of the cavitation proof layer 21 being 1,000 Å) as in the embodiment 7, the displacement accuracy and others are in good condition.

The unexpected non-discharge is studied in accordance with a 50% zigzag pattern, and using the A-4 sized printing medium placed in the vertical direction one-pass printing is executed. Whereas the unexpected non-discharges have occurred in some of the discharge ports 16 per one printing medium for the comparative examples 3 to 6, there have occurred none of them for the embodiments 4 to 7.

Figure 24:
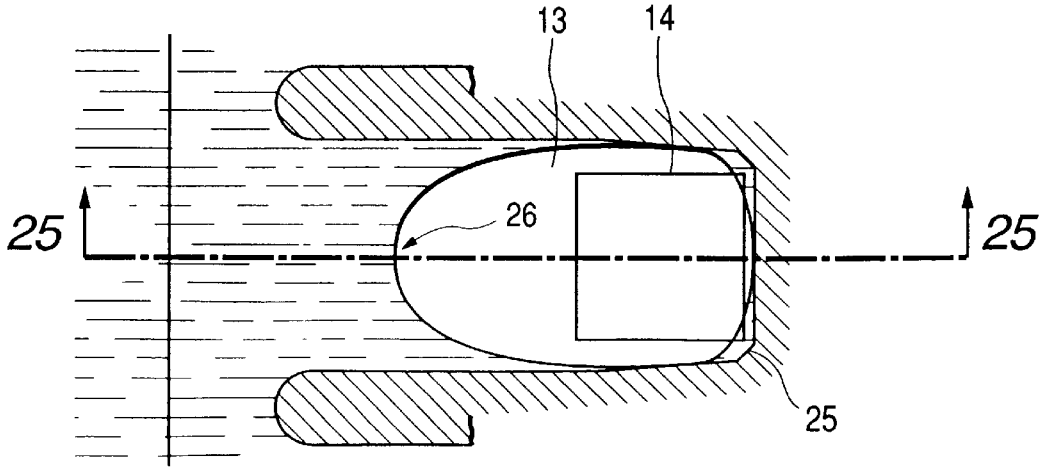
FIG. 24 is a cross-sectional view which shows the structure of the ink chamber of a liquid discharge head in accordance with a third embodiment of the present invention.
Figure 25:
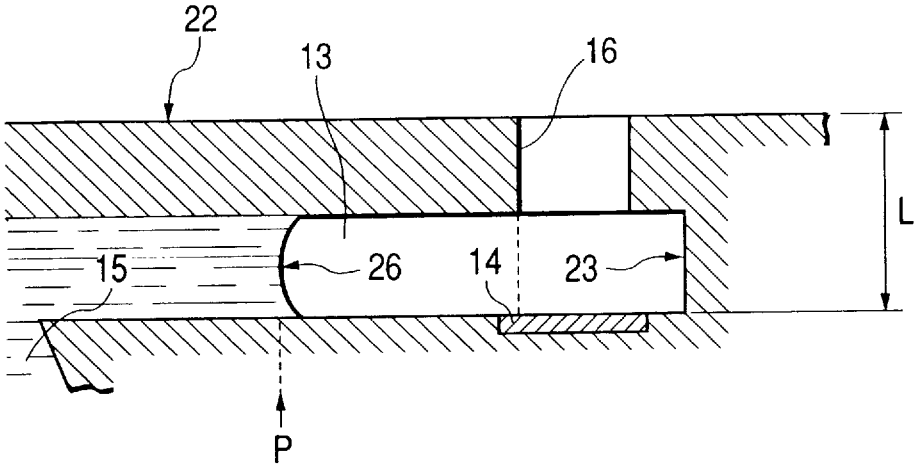
FIG. 25 is a cross-sectional view taken along line 25—25 indicated by arrows in FIG. 24.

The amount of meniscus retraction is actually measured after a bubble has been communicated with the air outside from the front end of discharge port 16 through the transparent plate having discharge ports arranged thereon. FIG. 24 shows this state, and FIG. 25 shows the sectional structure thereof taken along line 25—25 indicated by arrows in it. Here, only using the same reference marks to the members having the same functions in the previous embodiment any repetitive description will be omitted. It takes approximately 10 μs for the embodiment 4 to enable the ink meniscus 26 to arrive at the edge of the discharge port 16 from the position P where the meniscus has retracted most; approximately 12 μs for the embodiment 6; and approximately 22 μs for the comparative example 4. This is because the comparative example 4 has a large input energy for the electrothermal transducing element 14, and the viscosity of ink is lowered in the vicinity of the electrothermal transducing element 14 due to the temperature rise of ink in the vicinity of the electrothermal transducing element 14, hence the amount of meniscus retraction becoming larger to require more time for the meniscus to return. In contrast, the amount of meniscus retraction is smaller for the embodiments 4 and 6, which conceivably facilitates them to return quicker. As a result, the unexpected non-discharge is suppressed for the embodiments 4 and 6. Also, it is observed that with the stabilized discharges for the embodiments, the adhesion of ink droplets to the surface near the discharge ports is smaller for the embodiments than the comparative examples. This also contributes to suppressing the unexpected non-discharges therefor.

Also, regarding the viscous plug properties of ink, normal printing is carried out for the embodiments 4 and 6 even when the viscous plugging occurs, but not the comparative example 6. Conceivably, this is because the distance L is too long, while the driving pulse width is comparatively small, which results in the lower discharge speed of ink to make its viscosity higher to disable ink discharges. Therefore, it is desirable to set the distance L at 34 μm or less as in the embodiment 2.

As described above, with the thickness of the covering layer being set at 6,300 Å or less, as well as the input energy being 0.0027 $\mu J/\mu m^2$ or less per unit area of the electrothermal transducing element 14, and the driving pulse being the single pulse whose pulse width is 1.2 μs or less, it becomes possible to suppress the creation of corner bubble by stabilizing bubbling, and obtain a head capable of suppressing the unexpected non-discharge. Further, with the distance L being as small as 34 μm or less, it becomes possible to enhance the viscous plug properties of ink.

For the embodiment described above, the protection layer 20 and the cavitation proof layer 21 are laminated on the electrothermal transducing element 14. However, it may be possible to use an electrothermal transducing element formed by TaAl or the like. Then, the protection layer 20 is eliminated. This is also effective. In this case, the distance L is defined as a gap between a discharge port and the surface of an electrothermal transducing element 14.

Now, the description will be made of the case where printing is made by the ink jet head 11 at pitches of 2,400 dpi, while scanning it in the direction orthogonal to the arrangement direction of the discharge ports 16. In this case, the driving frequency of the electrothermal transducing element 14 is 30 kHz, and from one discharge port 16, discharge is made per approximately 33 μs at the minimum. For the electrothermal transducing element 14, TaSiN is used with its sheet resistive value of 100Ω. The protection layer 20 is formed by SiN whose film thickness is 3,000 Å. Further, Ta is used for the cavitation proof layer 21 in a film thickness of 2,300 Å.

The dimension of the electrothermal transducing element 14 is 17×17 μm in rectangle. The distance L from the surface of the cavitation proof layer 21 to the surface of discharge port 22 is 16 μm and 22 μm. The length of one side of the electrothermal transducing element is approximately 0.941 times and approximately 1.294 times, respectively. The height H of the ink chamber 13 is 12 μm. The discharge port 16 is circular, and the radius thereof is 5.75 μm. The distance S from the edge thereof to the one side end of the edge wall 23 is approximately 9.8 μm. All the other dimensions are the same as those of the previous embodiment.

As regards the displacement accuracy and viscous plug properties of ink droplets in accordance with the embodiment described above, evaluation is made with the result as shown in the Table 3 given below. The unit and other items are the same as the previous embodiment.

TABLE 3

| | Embodiment 8 | Embodiment 9 | Comparative Example 7 | Comparative Example 8 |
|---|---|---|---|---|
| Dimension of electrothermal transducing element (μm) | 17 × 17 | 17 × 17 | 17 × 17 | 17 × 17 |
| Distance L to discharge port surface (μm) | 22 | 16 | 22 | 22 |
| Film thickness of cavitation proof layer (Å) | 2300 | 2300 | 2300 | 2300 |
| Film thickness of protection layer (Å) | 3000 | 3000 | 8000 | 3000 |
| Input energy (μJ) | 0.73 | 0.73 | 1.14 | 0.73 |
| Input energy per unit area ($\mu J/\mu m^2$) | 0.0023 | 0.0023 | 0.0038 | 0.0023 |
| Driving voltage (V) | 9.2 | 9.2 | 12.0 | 6.2 |
| Driving pulse width (μs) | 0.9 | 0.9 | 0.9 | 2.0 |
| Ink droplet displacement accuracy (μm) | 4.1 | 4.2 | 6.6 | 6.9 |
| Presence of corner bubble | No | No | Yes | Yes |
| Unexpected non-discharge | None | None | Occurred | Occurred |

TABLE 3-continued

| | Embodiment 8 | Embodiment 9 | Comparative Example 7 | Comparative Example 8 |
|---|---|---|---|---|
| Ink viscous plug properties | Good | Good | Good | Good |
| Overall evaluation | Good | Good | Bad | Bad |

For the comparative example 7 against the embodiment 8, the film thickness of protection layer 20 is set at 8,000 Å, and for the comparative example 8, the driving pulse width is set at 2.0 μs.

When the film thickness of the protection layer 20 is the same, but the driving pulse width is different as in the case of the comparative example 8, it is arranged to make the input energy of the electrothermal transducing element 14 equal to that of the embodiment 8 by changing the driving voltage. Whereas it is impossible to enhance the displacement accuracy of the comparative example 7, the thickness of the protection layer 20 of which is 8,000 Å, even by making the driving pulse width smaller, the displacement accuracy is keep in good condition for the embodiments 8 and 9 the thickness of the protection layers 20 of which is 3,000 Å, respectively.

For the comparative example 7, the covering layer that includes the cavitation proof layer 21 is thick. Therefore, as compared with the example that has a thinner protection layer 20, the input energy for the electrothermal transducing element 14 and the input energy per unit area, which are needed to enable ink to rise to the temperature at which ink is bubbled, are high as shown in the Table 3. Then, the resultant bubbling temperature of the electrothermal transducing element 14 itself becomes high, hence raising the temperature of the protection layer 20 and cavitation proof layer 21 near the electrothermal transducing element 14. As a result, a bubble is affected by the steps and irregularities on the circumference of the electrothermal transducing element 14, and a bubble is subjected to being created easily to make the bubbling instable. Then, it is conceived that the displacement accuracy of the comparative example 7 becomes unfavorable.

Also, for the comparative examples 7 and 8, the corner bubble tends to be created to make the discharges instable. However, for the embodiments 8 and 9, bubbling is stabilized so as not to create a drawback of the kind.

As regards the unexpected non-discharge, the 50% zigzag pattern is one pass printed using the A4-sized printing medium which is placed vertically as in the case of the previous embodiment. The evaluation is made in the same manner as the previous embodiment. Then, whereas the unexpected non-discharges have occurred with some of discharge ports 16 on one printing medium for the comparative examples 7 and 8, there have been none of them for the embodiments 8 and 9.

In this respect, when the distance L from the surface of the cavitation proof layer 21 to the discharge port surface 22 is smaller than 1.3 times the length of one side of the electrothermal transducing element 14, the resultant viscous plug properties becomes comparatively favorable. Conceivably, this is because the larger the electrothermal transducing element 14, the higher becomes the discharge speed, which enhances the viscous plug properties more. Here, although the discharge speed of droplets is lowered particularly when the driving pulse is smaller, the ink viscosity resistance is made lower in the vicinity of the electrothermal transducing element 14 by making the distance L smaller. Conceivably, therefore, the resultant viscous plug properties are improved still more.

What is claimed is:

1. A liquid discharge head comprising:

discharge ports for discharging liquid which is normally liquid;

electrothermal transducing elements arranged to face said discharge ports for generating thermal energy utilized for discharging liquid from said discharge ports; and a covering layer for covering said electrothermal transducing elements, residing inclusively between said electrothermal transducing elements and the liquid, wherein, for each of said discharge ports, the gap between said discharge port and the surface of said covering layer is 34 μm or less, and the thickness of said covering layer is 6,300 Å or less, and a corresponding one of said electrothermal transducing elements generates thermal energy of 0.0027 $\mu J/\mu m^2$ or less by the application of a single driving pulse of 1.2 μs or less for creating film boiling in the liquid to discharge liquid from said discharge port, and wherein a bubble created by said film boiling communicates with the air outside.

2. A liquid discharge head according to claim 1, wherein the gap between said discharge port and the surface of said covering layer is 16 μm or more.

3. A liquid discharge head according to claim 1, wherein the thickness of said covering layer is 3,000 Å or more.

4. A liquid discharge head according to claim 1, wherein said covering layer is provided with a laminated structure, and a layer of said laminated structure on said electrothermal-transducing-element side is silicon nitride layer in a thickness of 4,000 Å or less.

5. A liquid discharge head according to claim 1, wherein said covering layer is provided with a laminated structure, and a layer of said laminated structure on the liquid side is a layer containing Ta.

6. A liquid discharge head according to claim 1, wherein single rectangular pulse of 0.6 μs or more is applied to said electrothermal transducing elements.

7. A liquid discharge head according to claim 1, wherein said electrothermal transducing elements generate thermal energy of 0.0013 $\mu J/\mu m^2$ or more.

8. A liquid discharge head according to claim 1, wherein said electrothermal transducing elements are each configured to be a square.

9. A liquid discharge head according to claim 8, wherein the gap between said discharge ports and the surface of said covering layer is smaller by 1.3 times than the length of one side of said electrothermal transducing elements.

10. A liquid discharge head according to claim 1, wherein a liquid flow path wall having one end thereof in the form of a cul-de-sac is arranged to surround a respective one of said electrothermal transducing elements, and the cul-de-sac wall of said liquid path wall is smoothly connected with the other path walls.

11. A liquid discharge head according to claim 1, further comprising an NMOS type power transistor connected with a respective one of said electrothermal transducing elements.

12. A liquid discharge head according to claim 1, further comprising wiring connected with said electrothermal transducing elements, the arrangement direction of said wiring being substantially orthogonal to the arrangement direction of said discharge ports.

13. A liquid discharge head according to claim 1, wherein said discharge ports are arranged at least in two lines parallel to each other, and deviated from each other by half pitch in the arrangement lines themselves.

14. A liquid discharge head according to claim 1, wherein the amount of droplet discharged from said discharge port is 5 picoliters or less.

15. A liquid discharge head according to claim 1, wherein liquid is ink and/or processing liquid for adjusting the printability of ink to be discharged onto a printing medium.

16. A liquid discharge head comprising:

discharge ports for discharging liquid which is normally liquid; and electrothermal transducing elements for generating thermal energy utilized for discharging the liquid from said discharge ports, said electrothermal transducing elements being directly in contact with the liquid, wherein the gap between said discharge ports and the surface of said covering layer is 34 $\mu$m or less, and each of said electrothermal transducing elements generates thermal energy of 0.0027 $\mu J/\mu m^2$ or less by the application of a single driving pulse of 1.2 $\mu$s or less for creating film boiling in the liquid to discharge the liquid from said discharge port, and wherein a bubble created by said film boiling communicates with the air outside.

17. A method for driving a liquid discharge head provided with discharge ports for discharging liquid which is normally liquid; electrothermal transducing elements arranged to face the discharge ports for generating thermal energy utilized for discharging the liquid from the discharge ports; and a covering layer for covering the electrothermal transducing elements, residing inclusively between the electrothermal transducing elements and the liquid, the gap between the discharge ports and the surface of the covering layer being 34 $\mu$m or less, and the thickness of the covering layer being 6,300 Å or less, said method comprising the step of:

applying a single driving pulse of 1.2 $\mu$s or less to one of the electrothermal transducing elements for generating thermal energy of 0.0027 $\mu J/\mu m^2$ or less to create film boiling in the liquid for discharging the liquid from a corresponding one of the discharge ports, wherein a bubble created by the film boiling communicates with the air outside.

18. A method for driving a liquid discharge head provided with discharge ports for discharging liquid which is normally liquid; and electrothermal transducing elements for generating thermal energy utilized for discharging liquid from the discharge ports, the electrothermal transducing elements being directly in contact with the liquid, and the gap between the discharge ports and the surface of the covering layer being 34 $\mu$m or less, said method comprising the step of:

applying a single driving pulse of 1.2 $\mu$s or less to one of the electrothermal transducing elements for generating thermal energy of 0.0027 $\mu J/\mu m^2$ or less to create boiling in the liquid for discharging the liquid from a corresponding one of the discharge ports, wherein a bubble created by the film boiling communicates with the air outside.

19. A cartridge comprising:

a liquid discharge head provided with discharge ports for discharging liquid which is normally liquid; electrothermal transducing elements arranged to face said discharge ports for generating thermal energy utilized for discharging the liquid from said discharge ports; and a covering layer for covering said electrothermal transducing elements, residing inclusively between said electrothermal transducing elements and the liquid, the gap between said discharge ports and the surface of said covering layer being 34 $\mu$m or less, and the thickness of said covering layer being 6,300 Å or less, and by applying a single driving pulse of 1.2 $\mu$s or less to one of said electrothermal transducing elements for generating thermal energy of 0.0027 $\mu J/\mu m^2$ or less to create film boiling in the liquid for discharging liquid from a corresponding one of said discharge ports, wherein a bubble created by the film boiling communicates with the air outside; and a liquid tank for storing liquid to be supplied to said liquid discharge head.

20. A cartridge according to claim 19, wherein said liquid tank is detachably mountable on said liquid discharge head.

21. A cartridge comprising:

a liquid discharge head provided with discharge ports for discharging liquid which is normally liquid; and electrothermal transducing elements for generating thermal energy utilized for discharging the liquid from said discharge ports, said electrothermal transducing elements being directly in contact with the liquid, and the gap between said discharge ports and the surface of said covering layer being 34 $\mu$m or less, and by applying a single driving pulse of 1.2 $\mu$s or less to one of said electrothermal transducing elements for generating thermal energy of 0.0027 $\mu J/\mu m^2$ or less to create boiling in the liquid for discharging the liquid from a corresponding one of said discharge ports, wherein a bubble created by said film boiling communicates with the air outside; and a liquid tank for storing liquid to be supplied to said liquid discharge head.

22. A cartridge according to claim 21, wherein said liquid tank is detachably mountable on said liquid discharge head.

23. An image forming apparatus comprising:

a liquid discharge head provided with discharge ports for discharging liquid which is normally liquid; electrothermal transducing elements arranged to face said discharge ports for generating thermal energy utilized for discharging the liquid from said discharge ports; a covering layer for covering said electrothermal transducing elements, residing inclusively between said electrothermal transducing elements and the liquid, the gap between said discharge ports and the surface of said covering layer being 34 $\mu$m or less, and the thickness of said covering layer being 6,300 Å or less; and a control unit for applying a single driving pulse of 1.2 $\mu$s or less to one of said electrothermal transducing elements for generating thermal energy of 0.0027 $\mu J/\mu m^2$ or less to create film boiling in the liquid for discharging liquid from a corresponding one of said discharge ports, wherein a bubble created by said film boiling communicates with the air outside.

24. An image forming apparatus according to claim 23, wherein said liquid discharge head is provided with a carriage for mounting said liquid head thereon to be able to move for scanning in the direction intersecting with the carrying direction of a printing medium to receive liquid discharged from said liquid discharge head.

25. An image forming apparatus according to claim 24, wherein said liquid discharge head is detachably mountable on said carriage.

26. An image forming apparatus according to claim 24, wherein said liquid discharge head is provided with wiring connected with said electrothermal transducing elements, and said wiring is formed in the direction of scanning movement of said carriage.

27. An image forming apparatus comprising:

a liquid discharge head provided with discharge ports for discharging liquid which is normally liquid; and electrothermal transducing elements for generating thermal energy utilized for discharging the liquid from said discharge ports, said electrothermal transducing elements being directly in contact with the liquid, and the gap between said discharge ports and the surface of said covering layer being 34 $\mu$m or less; and a control unit for applying a single driving pulse of 1.2 $\mu$s or less to one of said electrothermal transducing elements for generating thermal energy of 0.0027 $\mu J/\mu m^2$ or less to create boiling in the liquid for discharging liquid from a corresponding one of said discharge ports, wherein a bubble created by said film boiling communicates with the air outside.

28. An image forming apparatus according to claim 27, wherein said liquid discharge head is provided with a carriage for mounting said liquid head thereon to be able to move for scanning in the direction intersecting with the carrying direction of a printing medium to receive liquid discharged from said liquid discharge head.

29. An image forming apparatus according to claim 28, wherein said liquid discharge head is detachably mountable on said carriage.

30. An image forming apparatus according to claim 28, wherein said liquid discharge head is provided with wiring connected with said electrothermal transducing elements, and said wiring is formed in the direction of scanning movement of said carriage.

* * * * *

UNITED STATES PATENT AND TRADEMARK OFFICE

CERTIFICATE OF CORRECTION

PATENT NO. : 6,443,561 B1
DATED : September 3, 2002
INVENTOR(S) : Shuichi Murakami It is certified that error appears in the above-identified patent and that said Letters Patent is hereby corrected as shown below:

Column 1,
Line 16, “a” should read -- as a --.

Column 7,
Line 46, “a” should read -- an --.

Column 15,
Line 48, “sour” should read -- source --.

Column 17,
Line 20, “Beside,” should read -- Besides, --.

Column 18,
Line 23, “form” should read -- from --.

Signed and Sealed this

Eighteenth Day of February, 2003

JAMES E. ROGAN
*Director of the United States Patent and Trademark Office*